US005882828A

United States Patent [19]

Kato et al.

[11] Patent Number: 5,882,828

[45] Date of Patent: Mar. 16, 1999

[54] METHOD FOR PREPARATION OF PRINTING PLATE BY ELECTROPHOTOGRAPHIC PROCESS USING LIQUID DEVELOPER

[75] Inventors: Eiichi Kato; Yusuke Nakazawa, both of Shizuoka, Japan

[73] Assignee: Fuji Photo Film Co., Ltd., Kanagawa, Japan

[21] Appl. No.: 816,654

[22] Filed: Mar. 13, 1997

[30] Foreign Application Priority Data

Mar. 15, 1996 [JP] Japan ..... 8-059436

[51] Int. Cl.[6] ..... G03G 13/76; G03G 13/10

[52] U.S. Cl. ..... 430/49; 430/117; 430/114

[58] Field of Search ..... 430/49, 117, 114

[56] References Cited

U.S. PATENT DOCUMENTS

| | | | |
|---|---|---|---|
| 3,933,490 | 1/1976 | Tsuchiya | 430/117 |
| 5,019,477 | 5/1991 | Felder | 430/114 |
| 5,601,958 | 2/1997 | Kato et al. | 430/49 |
| 5,679,492 | 10/1997 | Chamberlain et al. | 430/117 |
| 5,700,612 | 12/1997 | Kato et al. | 430/49 |

*Primary Examiner*—Christopher D. Rodee
*Attorney, Agent, or Firm*—McAulay Nissen Goldberg Kiel & Hand, LLP

[57] ABSTRACT

A method for preparation of a printing plate by an electrophotographic process comprising, in order, a) forming a toner image on an electrophotographic light-sensitive element having a release surface by an electrophotographic process using a liquid developer comprising a dispersion medium having dispersed therein toner grains each containing at least one resin (A) having a glass transition point of from 20° C. to 80° C. or a softening point of from 35° C. to 100° C. and at least one resin (B) having a glass transition point or a softening point at least 2° C. lower than that of the resin (A), b) drying the toner image to remove the dispersion medium thereby causing at least partial adhesion between the toner grains, c) bringing the toner image into contact with an intermediate transfer medium having a surface adhesion force of not less than 3 gram·force at temperature ($T_1$) and not more than 40 gram·force at temperature ($T_2$), at the temperature ($T_1$) to transfer the toner image onto the intermediate transfer medium, and d) bringing the toner image into contact with a final receiving material having a surface capable of providing a hydrophilic surface suitable for lithographic printing at the time of printing at the temperature ($T_2$) higher than the temperature ($T_1$ to transfer the toner image onto the final receiving material. According to the method of the present invention, the toner image formed from a liquid developer is transferred with good efficiency onto the final receiving material through the intermediate transfer medium, and the printing plate obtained provides a large number of prints having highly accurate images free from background stain. An apparatus suitable for conducting the method is also disclosed.

18 Claims, 3 Drawing Sheets

METHOD FOR PREPARATION OF PRINTING PLATE BY ELECTROPHOTOGRAPHIC PROCESS USING LIQUID DEVELOPER

FIELD OF THE INVENTION

The present invention relates to a method for preparation of a printing plate by an electrophotographic process including transfer of a toner image formed on an electrophotographic light-sensitive element using a liquid developer via an intermediate transfer medium having an adhesive surface, and an apparatus used therefor, and more particularly to a method for preparation of a lithographic printing plate by an electrophotographic process wherein transferability of toner image is excellent and good image qualities are maintained during a plate making process thereby providing a printing plate which produces prints of good image qualities and an apparatus used therefor.

BACKGROUND OF THE INVENTION

Owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used.

Light-sensitive materials having high photosensitivity which may provide direct type printing plate precursors directly preparing printing plates based on the output from a terminal plotter include electrophotographic light-sensitive materials.

In order to form a lithographic printing plate using an electrophotographic light-sensitive material, a method wherein after the formation of toner image by an electrophotographic process, non-image areas are subjected to oil-desensitization with an oil-desensitizing solution to obtain a lithographic printing plate, and a method wherein after the formation of toner image, a photoconductive layer is removed in non-image areas to obtain a lithographic printing plate are known.

However, in these methods, since the light-sensitive layer is subjected to treatment for rendering it hydrophilic to form hydrophilic non-image areas or removed by dissolving out it in the non-image areas to expose an underlying hydrophilic surface of support, there are various restrictions on the light-sensitive material, particularly a photoconductive compound and a binder resin employed in the photoconductive layer. Further, printing plates obtained have several problems on their image qualities or pinning durability.

In order to solve these problems there is proposed a method comprising providing a transfer layer composed of a thermoplastic resin capable of being removed upon a chemical reaction treatment on a surface of an electrophotographic light-sensitive element, forming a toner image on the transfer layer by a conventional electrophotographic process using a liquid developer, transferring the toner image together with the transfer layer onto a receiving material capable of forming a hydrophilic surface suitable for a lithographic printing, and removing the transfer layer to leave the toner image on the receiving material whereby a lithographic printing plate is prepared as described in WO 93/16418.

According to the method for preparation of printing plate using the transfer layer, a printing plate having good image qualities is obtained without various restrictions on the photoconductive layer employed in the hitherto known methods as described above. However, in the above-described method, the step for removing the transfer layer by a chemical treatment is indispensable in order to prepare a printing plate. Thus, simplification on a process for the preparation of printing plate and improvement in working efficiency are still limited.

Also, a method comprising development of an electrostatic latent image on an electrophotographic light-sensitive element with a liquid developer and transfer of the toner image thus formed onto a receiving material such as paper has been known. Such a method, however, causes specific problems based on the liquid developer as described, for example, in Eiichi Inoue (supervised), *Shashin Kogaku no Kiso-Higin-enyou Shashin Hen*, p. 364, Nippon Shashin Gakkai (ed.), Corona (1982). Specifically, when the development is conducted using a liquid developer containing toner grains having a diameter of from 0.2 to 2 $\mu$m, a layer of carrier liquid having a thickness of from 100 to 200 $\mu$m is formed on the surface of electrophotographic light-sensitive element, and when the developed light-sensitive element is brought into contact with a receiving material to transfer, the toner image does not sufficiently adhere to the receiving material due to the presence of carrier liquid, resulting in decrease in transfer efficiency. On the other hand, when the carrier liquid is removed, adhesion force between the toner image and the surface of light-sensitive element becomes greater and the transfer efficiency of toner image tends to deteriorate. Therefore, decrease in image qualities on the transferred image cannot be avoided.

Various investigations on improving a liquid developer used and a transfer method have been made in order to solve the above-described problems.

One method comprising, after development of an electrostatic latent image on an electrophotographic light-sensitive element with a liquid developer, transferring the toner image thus formed to a receiving material by contacting together the surfaces of the electrophotographic light-sensitive element and the receiving material while maintaining a large amount of the carrier liquid under applying a transfer potential using a corona charger or a bias roller has been proposed. However, in this method the carrier liquid present between the light-sensitive element and the receiving material may flow during transfer to cause streaks in the transferred image.

In order to prevent such a defect, JP-B-51-44654 (the term "JP-B" as used herein means an "examined Japanese patent publication") discloses a method wherein a thickness of the carrier liquid on the light-sensitive element after development is controlled in a range of from 5 to 30 $\mu$m by corona discharge before the transfer of toner image. This method eliminates the above described problem by remaining the necessary and sufficient amount of carrier liquid for wet type transfer between the light-sensitive element and the receiving material and attains the improvement in transfer efficiency. Also, unnecessary penetration of the carrier liquid into the receiving material is depressed.

Although the streaks in the transferred image due to the excess carrier liquid present during the transfer are prevented to a certain extent by controlling the thickness of carrier liquid according to this method, there is another problem in that the toner image formed on the light-sensitive element per se is disordered by the corona discharge employed for controlling the thickness of carrier liquid, which results in the formation of cutting, distortion or spread of image.

JP-A-1-225975 (the term "JP-A" as used herein means an "unexamined published Japanese patent application") discloses a method wherein an amount of the remaining carrier liquid is controlled by introducing a drying step after development and then the toner image is transferred by a pre-charge step with corona discharge. However, in order to obtain a transferred image having good image qualities in a stable manner, it is necessary to extremely precisely control a space between the light-sensitive element and the receiving material.

There is a method for transfer the toner image by directly contacting the light-sensitive element bearing the toner image with a receiving material using a roller. This method, however, accompanies the flow of carrier liquid on the light-sensitive element and thus, the disorder of toner image on the light-sensitive element and the streaks in the transferred image may occur.

In order to prevent such defects, a method wherein two transfer rollers are provided and the opposite bias voltage are applied to these rollers is described in JP-B-46-1799. This method is not satisfactory, although the disorder of toner image is prevented to a certain extent.

Further, a method of interposing a resinous solution between the light-sensitive element and the receiving material to uniformly control the amount of toner transferred is disclosed in JP-A-55-95971, and a method of using a liquid developer containing spacer particles for preventing collapse of toner grains during transfer is disclosed in JP-A-59-100458, JP-A-60-95550 and JP-A-62-14168. However, these methods are still insufficient in view of the transfer efficiency or the disorder of toner image. In addition, when the receiving material having the toner image is employed as a printing plate, the resin used adheres to the surface of printing plate which tends to cause background stains on prints.

Moreover, various methods for transferring the toner image on the light-sensitive element to a receiving material not directly but through an intermediate transfer medium have been investigated. For instance, methods wherein the toner image is transferred from the light-sensitive element to an intermediate transfer medium is conducted by electrostatic transfer using corona discharge as described above and transfer to a final receiving material is performed by contact transfer using pressure together with heating are described in JP-A-63-34573, JP-A-2-264280, JP-A-3-243973, JP-A-4-50968, JP-A-4-507303, JP-A-5-503166 and JP-A-6-508444. Even in these methods, the toner image is not completely transferred from the light-sensitive element and the light-sensitive element must be cleaned. Also, it is difficult to fully dissolve the disorder of transferred image during the contact transfer with heating. Thus, these methods are yet insufficient for the formation of highly accurate image which is particularly required nowadays.

In order to solve various problems accompanied by the transfer to a final receiving material, JP-A-5-100579 discloses a method using two intermediate transfer media wherein the second intermediate transfer medium has an adhesive or adherent surface and transfer of the toner image to the first intermediate transfer medium is carried out electrostatically, and after drying the carrier liquid, the toner image is transferred by contact transfer to a final receiving material via the second intermediate transfer medium. However, since the method includes the increased number of transfer times, it is necessary to control each step with accuracy for obtaining the image having good image qualities in a stable manner. Further, construction of a device for transfer is complicated and it is difficult to assemble a simple and compact platemaking machine.

On the other hand, a method for transferring a conductive dry toner via an intermediate transfer medium having an adhesive surface is described, for example, in Tadashi Ogasawara and Masatoshi Kimura, *Daiyonkai Non-Impact Printing Gijutsu Symposium Ronbunshu*, p. 101 (1987). When the method is carried out using a liquid developer, transfer failure occurs due to decrease in the adhesion force of surface of intermediate transfer medium resulting from the contact with the carrier liquid, or transfer failure or disorder of tone image tends to occur during transfer to a final receiving material. Therefore, the specific problems based on a liquid developer has not been dissolved.

SUMMARY OF THE INVENTION

Therefore, an object of the present invention is to provide a method for preparation of an excellent transferred image in which a toner image formed on an electrophotographic light-sensitive element using a liquid developer is transferred to a support for a lithographic printing plate.

Another object of the present invention is to provide a transfer method which is excellent in transfer efficiency and maintains good durability of an electrophotographic light-sensitive element and an intermediate transfer medium when used repeatedly.

A further object of the present invention is to provide a method for preparation of a lithographic printing plate having good printing durability which produces a large number of prints having a highly accurate image without background stains.

A still further object of the present invention is to provide an apparatus for preparation of a lithographic printing plate having good image qualities which is suitable for use in a method wherein a toner image formed on an electrophotographic light-sensitive element by an electrophotographic process using a liquid developer is transferred to a final receiving material through an intermediate transfer medium having an adhesive surface.

Other objects of the present invention will become apparent from the following description.

It has been found that the above described objects of the present invention are accomplished by a method for preparation of a printing plate by an electrophotographic process comprising, in order, a) forming a toner image on an electrophotographic light-sensitive element having a release surface by an electrophotographic process using a liquid developer comprising a dispersion medium having dispersed therein toner grains each containing at least one resin (A) having a glass transition point of from 20° C. to 80° C. or a softening point of from 35° C. to 100° C. and at least one resin (B) having a glass transition point or a softening point at least 2° C. lower than that of the resin (A), b) drying the toner image to remove the dispersion medium thereby causing at least partial adhesion between the toner grains, c) bringing the toner image into contact with an intermediate transfer medium having a surface adhesion force of not less than 3 gram·force at temperature ($T_1$) and not more than 40 gram·force at temperature ($T_2$), at the temperature ($T_1$) to transfer the toner image onto the intermediate transfer medium, and d) bringing the toner image into contact with a final receiving material having a surface capable of providing a hydrophilic surface suitable for lithographic printing at the time of printing at the temperature ($T_2$) higher than the temperature ($T_1$) to transfer the toner image onto the final receiving material.

Alternatively, they are accomplished by a method for preparation of a printing plate by an electrophotographic process comprising, in order, a-1) forming a toner image on an electrophotographic light-sensitive element having a release surface by an electrophotographic process using a liquid developer comprising a dispersion medium having dispersed therein toner grains wherein the toner image has a stratified structure composed of a first image layer ($G_1$) formed from toner grains containing a resin (A) having a glass transition point of from 20° C. to 80° C. or a softening point of from 35° C. to 100° C. and provided thereon a second image layer ($G_2$) formed from toner grains containing a resin (B) having a glass transition point or a softening point at least 2° C. lower than that of the resin (A), b) drying the toner image to remove the dispersion medium thereby causing at least partial adhesion between the toner grains, c) bringing the toner image into contact with an intermediate transfer medium having a surface adhesion force of not less than 3 gram·force at temperature ($T_1$) and not more than 40 gram·force at temperature ($T_2$), at the temperature ($T_1$) to transfer the toner image onto the intermediate transfer medium, and d) bringing the toner image into contact with a final receiving material having a surface capable of providing a hydrophilic surface suitable for lithographic printing at the time of printing at the temperature ($T_2$) higher than the temperature ($T_1$) to transfer the toner image onto the final receiving material.

BRIEF DESCRIPTION OF THE ACCOMPANYING DRAWINGS

Figure 1:
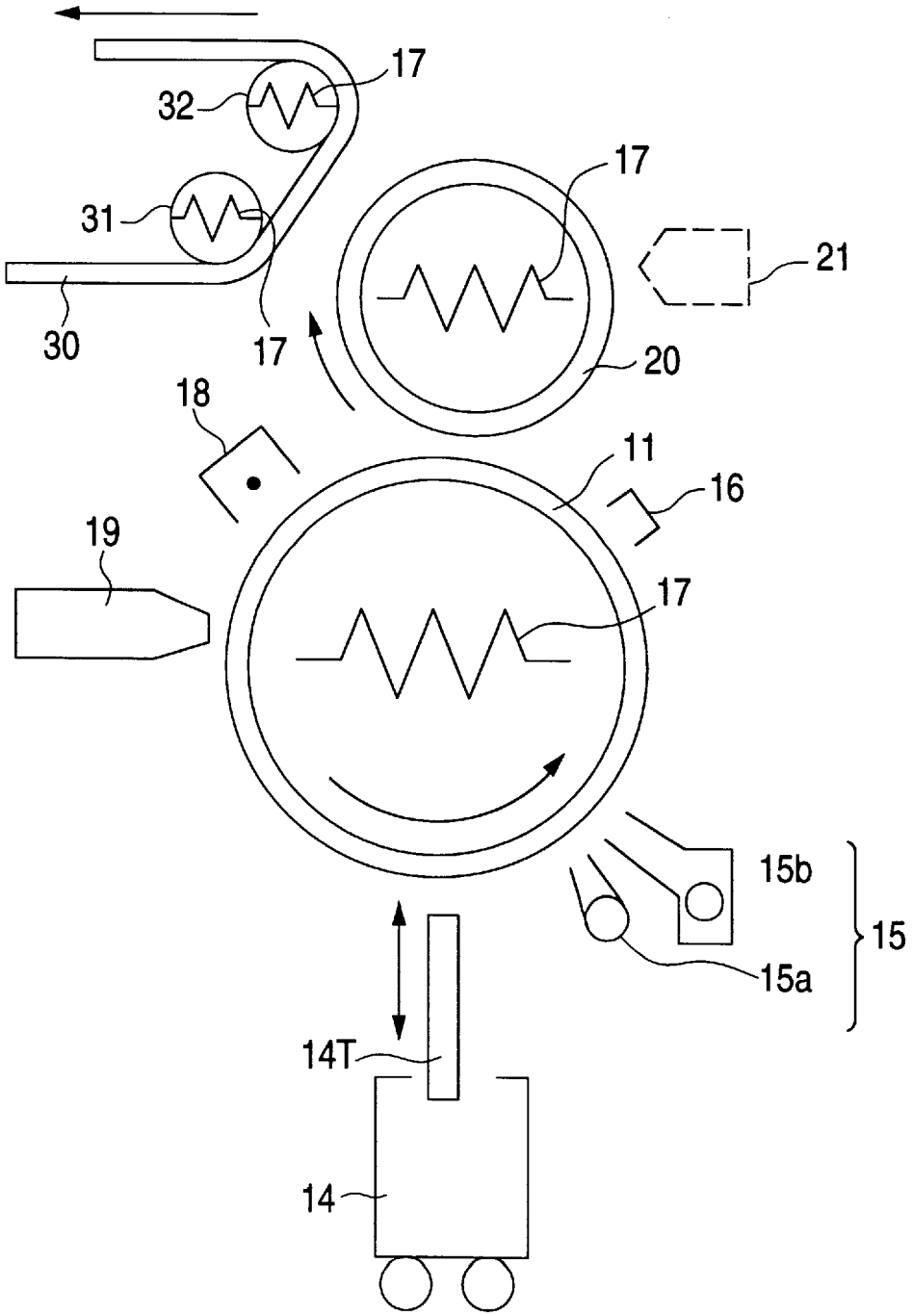
FIG. 1 is a schematic view of an apparatus for preparation of a printing plate by an electrophotographic process suitable for performing the method according to the present invention in which a primary receptor of a drum type is used.

| Explanation of the Symbols: | |
|---|---|
| 11 | Light-sensitive element |
| 14 | Liquid developing unit set |
| 14T | Toner image forming unit |
| 15 | Suction/exhaust unit |
| 15a | Suction part |
| 15b | Exhaust part |
| 16 | Heating means |
| 17 | Temperature controller |
| 18 | Corona charger |
| 19 | Exposure device |
| 20 | Intermediate transfer medium |

-continued

| Explanation of the Symbols: | |
|---|---|
| 21 | Cleaning unit |
| 22 | Cooling part |
| 30 | Final receiving material |
| 31 | Backup roller for transfer |
| 32 | Backup roller for release |

DETAILED DESCRIPTION OF THE INVENTION

According to the method of the present invention, a toner image containing both the resin (A) and the resin (B) on an electrophotographic light-sensitive element having a release an electrophotographic process using a liquid developer in the manner described above and before contact transfer of the toner image to an intermediate transfer medium, a dispersion medium contained in the toner image on the electrophotographic light-sensitive element is removed by drying.

Owing to the removal of dispersion medium which brings about the disorder of toner image during the contact transfer, the toner image even in highly accurate image portions, for example, dots such as a range of from 2% to 99% in dots of 175 lines per inch, fine lines such as lines of 10 $\mu$m in width and fine letters such as 1.7 point size of Ming-zhao character can be completely transferred without defects such as cutting or distortion onto the intermediate transfer medium. Such excellent transfer is believed to be based on the formation of partial adhesion between the toner grains resulting from increase in the interaction of toner grains due to the evaporation of dispersion medium from the toner image portion comprising the resin (A) and the resin (B). As a result, cohesive force in the toner image increases and cohesive destruction in the toner image is prevented when the toner image is released from the surface of electrophotographic light-sensitive element and transferred to the intermediate transfer medium. Depending on a thermal property of the toner grains employed, the formation of partial adhesion between the toner grains in accelerated by applying a heat-drying means, if desired.

It has been formed that the toner image having a stratified structure composed of the resin (A) and the resin (B) having glass transition or softening points different from each other present in respective layers ($G_1$) and ($G_2$) as described above exhibits the excellent transferability under transfer conditions of lower transfer temperature or higher transfer speed. This is believed to be resulted from not only increased releasability of toner image from the electrophotographic light-sensitive element owing to the resin (A) having a relatively high glass transition point or a softening point present in the first image layer ($G_1$) but also increase in adhesion to the surface of intermediate transfer medium due to the resin (B) having a glass transition point or a softening point lower than that of the resin (A) present in the second image layer ($G_2$).

Also, when a rinse treatment with an electrically insulating organic solvent same as the carrier liquid used in the liquid developer is carried out after the liquid development of latent images on the electrophotographic light-sensitive element in the method of the present invention in order to remove toner grains adhered in the non-image portion which form fogs, the layer of organic solvent having a thickness of several hundred $\mu$m is removed by the subsequent drying step to cause the partial adhesion between the toner grains.

Since the adhesive surface of intermediate transfer medium is prevented from contact with the carrier liquid, the intermediate transfer medium maintains its ability and is durable to repeated use.

According to the method of the present invention, the cohesive force in the toner image is maintained during contact transfer with heating to the intermediate transfer medium and the intermediate transfer medium having the specific surface adhesion force described in detail below is used. Thus, contact transfer is completely performed even when a speed for the transfer is increased.

The method of the present invention is also characterized in that the toner image is transferred by contact transfer via an intermediate transfer medium and the intermediate transfer medium has the specific adhesive surface. More specifically, the surface adhesion force of the intermediate transfer medium is not less than 3 g·f, preferably not less than 5 g·f at the surface temperature ($T_1$) used for transfer of the toner image from the electrophotographic light-sensitive element to the intermediate transfer medium (hereinafter referred to as a first transfer sometimes), and it is not more than 40 g·f, preferably not more than 35 g·f and more preferably not more than 20 g·f at the surface temperature ($T_2$) which is higher than the temperature ($T_1$) used for transfer the toner image from the intermediate transfer medium to a final receiving material, i.e., a support for a lithographic printing plate (hereinafter referred to as a second transfer sometimes). The surface adhesion force of intermediate transfer medium is preferably not more than 100 g·f at the temperature ($T_1$) and not less than 0.5 g·f at the temperature ($T_2$).

The surface of intermediate transfer medium according to the present invention exhibits adhesion (i.e., the surface adhesion force of not less than 3 g·f) sufficient for releasing the toner image from the release surface of electrophotographic light-sensitive element at the temperature ($T_1$) of the first transfer, and maintain sufficiently small adhesion (i.e., the surface adhesion force of not more the 40 g·f) at the temperature ($T_2$) to the second transfer thereby fully transferring the toner image to the final receiving material. Accordingly, the toner image of high accuracy can be wholly transferred without the formation of disorder of image as described above.

In summary, the intermediate transfer medium of the present invention is characterized by having the property capable of changing its surface adhesion force depending on temperature used for contact transfer under condition of applying heat and pressure and of maintaining small surface adhesion force at high temperature.

Measurement of the surface adhesion force of intermediate transfer medium described above is conducted according to JIS Z 0237-1980 8.3.1. 180 *Degrees Peeling Method* with the following modifications at the temperature ($T_1$) or temperature ($T_2$):

(i) As a test plate, an intermediate transfer medium having an adhesive surface.

(ii) As a test piece, a polyester film of 20 mm in width (Fuji PT Film having a thickness of 50 $\mu$m manufactured by Fuji Photo Film Co., Ltd.) is used.

(iii) A peeling rate is 50 mm/min using a constant rate of traverse type tensile testing machine.

Specifically, the test piece is laid on the test plate and a roller is reciprocate one stroke under a nip pressure of 4 Kgf/cm$^2$ at a rate of approximately 300 mm/min upon the test piece for pressure sticking. Within 20 to 40 minutes after the sticking with pressure, a part of the stuck portion is peeled approximately 25 mm in length and then peeled continuously at the rate of 50 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

In the present invention, it is preferred that the intermediate transfer medium having the adhesive surface has an elastomer layer having a thickness greater than one of the toner image formed. Since the elastomer layer of the intermediate transfer medium acts as a cushion for the toner image during contact transfer under pressure, the transferability of toner image is improved and further the transferred image is prevented from distortion.

In accordance with another preferred embodiment of the present invention, a surface temperature of the electrophotographic light-sensitive element at the time of conducting the electrophotographic process using the liquid developer is almost same as the temperature ($T_1$) at the time of the contact transfer of the toner image formed on the electrophotographic light-sensitive element to the intermediate transfer medium.

Not only the total time for the method is shortened, but also a means for controlling the surface temperature of electrophotographic light-sensitive element in each step becomes unnecessary, resulting in simplification of the apparatus.

Now, the electrophotographic light-sensitive element which can be used in the present invention will be described in detail below.

Any conventionally known electrophotographic light-sensitive element can be employed. What is important is that the surface of electrophotographic light-sensitive element has the releasability at the time of the formation of toner image so as to easily release afterward the toner image to be formed thereon.

More specifically, an electrophotographic light-sensitive element wherein adhesive strength of the surface thereof measured according to the method described below is not more than 20 gram·force (g·f) is preferably employed.

The measurement of adhesive strength is conducted according to JIS Z 0237-1980 8.3.1. 180 *Degrees Peeling Method* with the following modifications:

(i) As a test plate, an electrophotographic light-sensitive element on which a toner image is to be formed is used.

(ii) As a test piece, a pressure sensitive adhesive tape of 6 mm in width prepared according to JIS C2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesive strength of the surface of electrophotographic light-sensitive element is preferably not more than 15 g·f, more preferably not more than 10 g·f, and particularly preferably not more than 8 g·f.

Using such an electrophotographic light-sensitive element having the controlled adhesion, the toner image formed on the electrophotographic light-sensitive element is easily and completely transferred onto the intermediate transfer medium.

The electrophotographic light-sensitive element having a release surface which can be used in the present invention includes an electrophotographic light-sensitive element which has already a surface exhibiting the desired releasability.

Suitable examples of the electrophotographic light-sensitive element previously having the release surface include an electrophotographic light-sensitive element employing a photoconductive substance which is obtained by modifying a surface of amorphous silicon to exhibit the releasability and an electrophotographic light-sensitive element comprising a photoconductive layer provided thereon an overcoat layer containing a polymer which has a polymer component containing at least one of a fluorine atom and a silicon atom and crosslinked in the region near to the outer surface thereof.

Such a type of electrophotographic light-sensitive element is advantageous in that its surface has excellent releasability, in that the excellent releasability of its surface does not deteriorate when contact with a carrier liquid of a liquid developer in the electrophotographic process and contact of its non-image portion with an intermediate transfer medium in the step of contact transfer under application of heat and pressure are repeated, and in that it does not adversely affect the adhesion of intermediate transfer medium. Also, the overcoat layer described above hardly swells when it is in contact with the carrier liquid or subjected to the electrophotographic process under a heating condition such as at the temperature ($T_1$). Therefore, on the electrophotographic light-sensitive element, a highly accurate duplicated image without distortion is formed.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750.

Also, a method of adsorbing and fixing a releasing compound (S) containing a moiety having a fluorine atom and/or a silicon atom on a surface of amorphous silicon electrophotographic light-sensitive element is employed to provide the electrophotographic light-sensitive element having a release surface. For instance, an amorphous silicon electrophotographic light-sensitive element is immersed in a solution containing 0.1 to 5% by weight of the compound (S) dissolved in a solvent and dried to be adsorbed and fixed the compound (S) on the surface of electrophotographic light-sensitive element.

The compound (S) is a compound containing a fluorine atom and/or a silicon atom. The compound (S) containing a moiety having a fluorine and/or silicon atom is not particularly limited in its structure as far as it can improve releasability of the surface of amorphous silicon electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since the well adsorb on the surface of amorphous silicon electrophotographic light-sensitive element to impart good releasability.

Specific examples of the compound (S) containing a fluorine and/or silicon atom which can be used in the present invention include fluorine and/or silicon-containing organic compounds described, for example, in Tokiyuki Yoshida, et al. (ed.) *Shin-ban Kaimenkasseizai Handbook*, Kagaku Tosho (1987), Takao Karikome (supervised), *Saishin Kaimenkasseizai Oyo Gilutsu*, C. M. C. (1990), Kunio Ito (ed.), *Silicone Handbook*, Nikkan Kogyo Shinbunsha (1990), Takao Karikome (supervised), *Tokushukino Kaimenkasseizai*, C. M. C. (1986), and A. M. Schawartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C. M. C. (1987), Jiro Hirano et al. (ed.), *Ganfussoyukikagobutsu—Sono Gosei to Oyo*, Gijutsu Joho Kyokai (1991), and Mitsuo Ishikawa (supervised), *Yukikeiso Senryaku Shiryo*, Chapter 3, Science Forum (1991).

When the compound (S) is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block.

With respect to the compound (S) and application thereof to the electrophotographic light-sensitive element, reference can be made to JP-A-7-5727.

The overcoat layer provided as the uppermost layer of the electrophotographic light-sensitive element for imparting the releasability as described above preferably has a surface energy of not more than 30 erg·cm$^{-1}$. To control the surface energy in such a range provides the electrophotographic light-sensitive element having its surface adhesive strength of 20 g·f suitable for performing the complete transfer of toner image. The surface energy of overcoat layer is preferably not more than 28 erg·cm$^{-1}$, more preferably not more than 25 erg·cm$^{-1}$, and particularly preferably in a range of from 15 erg·cm$^{-1}$ to 25 erg·cm$^{-1}$.

One example for controlling the surface energy of overcoat layer in the range descried above is to incorporate a silicone resin or a fluorinated resin into the overcoat layer.

A resin containing both a silicon atom and a fluorine atom is also employed as the releasability-imparting resin in the present invention.

The fluorinated resin includes resins mainly composed of a polymer component containing a moiety having a fluorine atom. The moiety having a fluorine atom contained in the resin includes that incorporated into the main chain of polymer and that contained as a substituent in the side chain of polymer.

The fluorine atom-containing moieties include monovalent or divalent organic residues, for example, —$C_nF_{2n+1}$ (wherein n represents an integer of from 1 to 22), —$CFH_2$, —$(CF_2)_mCF_2H$ (wherein m represents an integer of from 1 to 17), —$CF_2$— and —CFH—.

The fluorine atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., $$-O-,\quad -S-,\quad -\overset{\overset{d^1}{|}}{N}-,\quad -CO-,$$

$$-SO-,\quad -SO_2-,\quad -COO-,\quad -OCO-,$$

$$-CONHCO-,\quad -NHCONH-,\quad -\overset{\overset{d^1}{|}}{CON}-,\quad \text{and}\quad -\overset{\overset{d^1}{|}}{SO_2N}-,$$

wherein $d^1$ represents an alkyl group having from 1 to 3 carbon atoms.

The polymer component containing a fluorine atom is preferably present in a range of from 80 to 99 parts by weight per 100 parts by weight of the total polymer component of the resin.

The resin also contains a curable functional group. The content of curable functional group in the resin is preferably from 1 to 20% by weight. The curable functional group used will be described in greater detail with respect to the silicone resin hereinafter.

A weight average molecular weight of the fluorinated resin is preferably from $5\times10^3$ to $1\times10^6$, and more preferably from $2\times10^4$ to $5\times10^5$.

The silicone resin includes resins mainly composed of polymer component containing a moiety having a silicon atom. Specific examples of the silicone resins used in the present invention include polymers mainly composed of an organo siloxane repeating unit represented by the general formula (I) shown below.

$$\left(\overset{\overset{R_1}{|}}{\underset{\underset{R_2}{|}}{Si}}-O\right) \qquad (I)$$

wherein $R_1$ and $R_2$, which may be the same or different, each represents an aliphatic or aromatic hydrocarbon group or a heterocyclic group.

The hydrocarbon group represented by $R_1$ or $R_2$ includes preferably a straight chain or branched chain alkyl group having from 1 to 18 carbon atoms which may be substituted (e.g., methyl, ethyl, propyl, butyl, pentyl, hexyl, heptyl, octyl, nonyl, decyl, dodecyl, tridecyl, tetradecyl, hexadecyl, octadecyl, 2-fluoroethyl, trifluoromethyl, 2-chloroethyl, 2-bromoethyl, 2-cyanoethyl, 2-methoxycarbonylethyl, 2-methoxyethyl, 3-bromopropyl, 2-methoxycarbonylethyl, 2,3-dimethoxypropyl, $-(CH_2)_pC_rF_{2r+1}$ (wherein p represents an integer of 1 or 2; and r represents an integer of from 1 to 12), or $-(CH_2)_p-(CF_2)_s-R'$ (wherein p represents an integer of 1 or 2; s represents an integer of from 1 to 12 and R' represents $-CFHCF_3$ or $-CFHCF_2H$)), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, or linolyl) an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclopentyl, cyclohexyl, 2-cyclohexylethyl, 2-cyclopentylethyl, polyfluorohexyl, methylcyclohexyl, or methoxycyclohexyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, fluorophenyl, chlorophenyl, difluorophenyl, bromophenyl, cyanophenyl, acetylphenyl, methoxycarbonylphenyl, ethoxycarbonylphenyl, butoxycarbonylphenyl, acetamidophenyl, propionamidophenyl, or trifluoromethylphenyl).

The heterocyclic group represented by $R_1$ or $R_2$ includes preferably a 5-membered or 6-membered heterocyclic ring containing at least one hetero atom selected from nitrogen atom, an oxygen atom and a sulfur atom which may be substituted and may form a condensed ring. Suitable examples of heterocyclic ring include pyrane, furan, thiophene, morpholine, pyrrole, thiazole, oxazole, pyridine, piperidine, pyrrolidone, benzothiazole, benzoxazole, quinoline, or tetrahydrofuran.

It is preferred that both $R_1$ and $R_2$ are methyl groups.

Of the silicone resins, those having a dimethylsiloxane unit, i.e., $R_1$ and $R_2$ each represents a methyl group in the general formula (I), not less than 60% by weight based on the total organo siloxane unit are preferred. The content of dimethylsiloxane unit in the resin is more preferably not less than 75% by weight based on the total organic siloxane unit. By using such a silicone resin, the releasability is well maintained and thus the complete transfer of toner image is easily achieved.

As the specific component for increasing the adhesion between the overcoat layer and the surface of electrophotographic layer, a group represented by the general formula (I) wherein $R_1$ and $R_2$ each represents a substituted alkyl group (e.g. an alkyl group substituted with a halogen atom or a cyano group), or a substituted or unsubstituted aralkyl, aromatic or heterocyclic group is employed.

Further, the hydrocarbon group or heterocyclic group represented by $R_1$ or $R_2$ containing a polar group, for example, a carboxy group, a hydroxy group, a mercapto group, a phospho group or an amido group, or a divalent connecting group, for example, a ureido group (—NHCONH—), a thioether group (—S—) or a urethane group (—NHCOO—) is also employed to increase the adhesion.

The content of an organo siloxane unit having such a substituent is preferably less than 40% by weight, more preferably less than 25% by weight based on the total organo siloxane unit.

The dimethylsiloxane unit preferred as the releasability-increasing component and the other organo siloxane unit for increasing adhesion are preferably present in the above described range and form any of a random copolymer, a block copolymer and a star copolymer without a particular limitation. Using such a resin in the overcoat layer, it is possible to maintain the releasability on the surface side and to increase the adhesion to the photoconductive layer.

A weight average molecular weight of the silicone resin is preferably from $5\times10^3$ to $1\times10^6$, and more preferably from $2\times10^4$ to $5\times10^5$.

The resin layer constituting the overcoat layer used in the present invention is characterized in that it is cured to form a crosslinked structure therein.

Any conventionally known method for curing a resin to form a crosslinked structure can be employed to form the cured resin layer. A silicone resin is used as an example in the following description.

For example, a self-crosslinking method of a silicone resin, a method of curing a silicone resin using a crosslinking agent or curing agent, or a combination thereof can be employed.

A reaction mode of the crosslinking reaction of resin includes any conventionally known chemical reaction to form a bond. Also, a combination of such a reaction can be used.

Specific examples of the reaction mode include the following reactions i) to iv):

i) Crosslinking with an ion bond formed by a chelate reaction between an acidic group (e.g., a carboxy group, a sulfo group, or a phosphono group) contained in the resin and a poly-valent metal ion including a cation of poly-valent metal (e.g., Ca, Mg, Ba, Al, Zn, Fe, Sn, Zr or Ti).

ii) Crosslinking with a chemical bond formed by an addition reaction, a substitution reaction or an elimination reaction between organic reactive groups (for example, a hydroxy group, a thiol group, a halogen atom (e.g., a chlorine atom, a bromine atom or an iodine atom), a carboxy group, an acid anhydride group, an amino group, an isocyanate group, a protected isocyanate group (a blocked isocyanate group), an acid halide group, an epoxy group, an imino group, a formyl group, a diazo group or an azido group).

iii) Self-crosslinking with a self-coupling group (for example, —$CONHCH_2OR_1'$ (wherein $R_1'$ represents a hydrogen atom or an alkyl group),

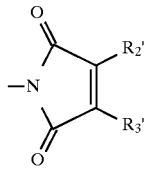

(wherein $R_2'$ and $R_3'$, which may be the same or different, each represents a hydrogen atom or an alkyl group, or $R_2'$ and $R_3'$ may combine each other to form a 5-membered or 6-membered alicyclic ring), a cinnamoyl group or —$Si(R_4')_s(OR_5')_t$ (wherein $R_4'$ represents an alkyl group, an alkenyl group or an aryl group; $R_5'$ represents an alkyl group, s represents an integer of from 0 to 2; and t represents an integer of from 1 to 3, provided that s+t=3)).

iv) Crosslinking by an addition polymerization reaction of a polymerizable double bond group or a polymerizable triple bond group. Suitable examples of the polymerizable double bond group include $CH_2{=}C(p)COO$—, $C(CH_3)H{=}CHCOO$—, $CH_2{=}C(CH_2COOH)COO$—, $CH_2{=}C(p)CONH$—, $CH_2{=}C(p)CONHCOO$—, $CH_2{=}C(p)CONHCONH$—, $C(CH_3)H{=}CHCONH$—, $CH_2{=}CHCO$—, $CH_2{=}CH(CH_2)_nOCO$—, $CH_2{=}CHO$—, $CH_2{=}CHC_6H_4$— and $CH_2{=}CH$—S— wherein p represents a hydrogen atom or a methyl group; and n represents an integer of from 0 to 3. Suitable examples of the polymerizable triple bond group include these groups described above but replacing the double bond with a triple bond.

The reactive group appropriately selected is introduced into the silicone resin through a linking group, if desired. Specifically, (1) either $R_1$, $R_2$ or both per se of the organo siloxane unit represented by the general formula (I) is replaced with the reactive group, or either $R_1$, $R_2$ or both of the organo siloxane unit includes the reactive group, (2) a repeating unit of the silicone resin other than the organo siloxane unit includes the reactive group, or (3) the silicone resin includes the reactive group at the terminal of its polymer chain.

Further, conventionally known specific crosslinking reactions of organo siloxane polymer are effectively employed. These methods are described in details, for example, in Kunio Ito (ed.), *Silicone Handbook*, Nikkan Kogyo Shinbunsha (1990) and Makoto Kumade and Tadashi Wada (supervised), *Saishin Silicone Gijutsu-Kaihatsu to Oyo-*, C. M. C. (1986). Specific examples of the reactive group include the followings.

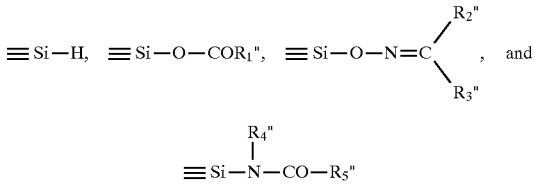

(wherein $R_1''$, $R_2''$, $R_3''$, $R_4''$ or $R_5''$ each represents an alkyl group).

The units containing curable reactive group are present at random in the polymer chain of silicone resin with organo siloxane units represented by the general formula (I) which exhibit releasability in case of a random copolymer. The silicone resin also can be a so-called block copolymer wherein a block for releasability and a block for curing are bonded. The forms of block include a graft type block, an AB type block (including an ABA type block) and a star type block.

The content of the block for releasability in the block copolymer is preferably not less than 30% by weight, and more preferably not less than 50% by weight based on the total polymer component of the silicone resin.

The crosslinking agents or curing agents capable of forming a crosslinked structure in the silicone resin include low molecular weight compounds, oligomers and polymers which are conventionally known as heat-, photo- or moisture-curable compounds. These compounds can be employed individually or in a combination of two or more thereof.

Suitable examples of the crosslinking agent or curing agent used in the present invention include those described, for example, in Shinzo Yamashita and Tosuke Kaneko (ed.), *Kakyozai Handbook*, Taiseisha (1981), Kobunshi Gakkai (ed.), *Kobunshi Data Handbook* (*Kiso-hen*), Baifukan (1986), Tsuyoshi Endo, *Netsukokasei Kobunshi no Seimitsuka*, C. M. C. (1986), Yuji Harasaki, *Saishin Binder Gijutsu Binran*, Ch. II-1, Sogo Gijutsu Center (1985), Takayuki Otsu, *Acryl Jushi no Gosei·Sekkei to Shinyoto Kaihatsu*, Chubu Kei-ei Kaihatsu Center Shuppanbu (1985), and *Silicon Handbook*, supra.

Specific examples of suitable crosslinking agents or curing agents include organosilane compounds (e.g., vinyltrimethoxysilane, vinyltriethoxysilane, γ-glycidoxypropyltrimethoxysilane, γ-mercaptopropyltriethoxysilane, γ-aminopropyltriethoxysilane), vinyltrichlorosilane, vinyltris-(t-butyl-peroxido)silane, γ-(β-aminoethyl)aminopropyltrimethoxysilane, γ-chloropropyltrimethoxysilane, γ-methacryloxypropyltrimethoxysilane, and silane coupling agents), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), blocked polyisocyanate compounds in which isocyanate groups of the above described polyisocyanate compounds are protected (examples of compounds used for the protection of isocyanate group including alcohols, β-diketones, β-ketoesters, and aminos), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxy-propylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum tris(acetylacetate)), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea·Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei* Acryl-kei Jushi, Techno System (1985)).

Specific examples of the polymerizable functional groups which are contained in the polyfunctional monomer or oligomer (the monomer will sometimes be referred to as a polyfunctional monomer (d)) having two or more polymerizable functional groups include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

If desired, a reaction accelerator may be used together with the resin for accelerating the crosslinking reaction in the overcoat layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include heat-polymerization initiators, such as peroxides and azobis compounds, and photo-polymerization initiators and sensitizers, such as those described, for example, in P. Walker, N. J. Webers, et al., *J. Phot. Sci.*, vol. 18, page 150 (1970) and Katsumi Tokumaru and Shin Okawara (ed.), *Zokanzai*, Kodansha (1987) and including carbonyl compounds, organic sulfur compounds, azine compounds and azo compounds.

In order to accelerate curing or control reaction of the silicone resin, a platinum catalyst, methylvinyltetrasiloxane, or an acetylene alcohol is used.

The condition of curing is appropriately selected depending on each elements to be employed.

Heat-curing is conducted in a conventional manner. For example, the heat treatment is carried out at 60° to 150° C. for 5 to 120 minutes. The condition of the heat treatment may be made milder by using the above-described reaction accelerator in combination.

Curing of the resin containing a photocurable functional group can be carried out by incorporating a step of irradiation of actinic ray into the method. The actinic rays to be used include visible light, ultraviolet light, far ultraviolet light, electron beam, x-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 cm to 50 cm for 10 seconds to 10 minutes.

The content of resin for release in the overcoat layer is preferably 60% by weight or more, and more preferably 80% by weight or more based on the total weight of composition of the resin layer.

The overcoat layer used in the present invention can contain other resins in a range which does not adversely affect the releasability together with the resin for release in order to increase the adhesion between the overcoat layer and the surface of electrophotographic light-sensitive layer.

As the resin for increasing the adhesion, conventionally known various kinds of resins having a softening point of not less than 35° C., preferably not less than 40° C. may be employed. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymer, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, polycarbonate resins, ketone resins, polyester resins, amide resins, alkyl-modified nylon resins, hydroxy- or carboxy-modified polyester resins, butyral resins, polyvinyl acetal resins, cyclized rubber-methacrylic ester copolymers, cyclized rubber-acrylic ester copolymers, cellulose acetate resins, urethane resins, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings) and epoxy resins.

The content of resin for increasing the adhesion in the overcoat layer is preferably less than 40% by weight, and more preferably less than 20% by weight based on the total weight of resins employed.

The resin for increasing the adhesion may contain a heat-, photo- or moisture-curable reactive group as described above.

Of the resins for increasing the adhesion, vinyl alkanoate polymers or copolymers, acrylic resins, methacrylic resins, vinyl chloride resins, cellulose acetate resins, urethane resins and epoxy resins are particularly preferred.

In order to achieve the good releasability and the good adhesion in the overcoat layer, the resin for increasing the adhesion is made compatible with the resin for release using the method described, for example, in Gijutsujoho Kyokai (ed.), *Kobunshi no Soyoka to Hyokagijutsu*, (1992) and Seiichi Nakahama et al, Kobunshi Gakkai (ed.), *Kokino Polymer Alloy*, Maruzen (1991).

In the layer composed of a mixture of the resin for release and the resin for increasing the adhesion, the characteristic of the resin for release in that it tends to move near the surface of the layer can be utilized. In such a case, it is preferred, as one of the resins for increasing the adhesion, to further employ a copolymer containing a block composed of a polymer component having a fluorine atom and/or a silicon atom same as in the resin for release in a small amount in order to increase the interaction between the resins and to increase the cohesion in the layer.

The overcoat layer used in the present invention may have a stratified structure. For example, a double-layer structure wherein a resin layer having good adhesion (adhesive function layer) is provided adjacent to the electrophotographic layer and thereon a layer having good releasability (release function layer) is employed.

Maintenance of adhesion between the adhesive function layer and the release function layer can be performed by adding a copolymer containing a block composed of a polymer component compatible with the resin for increasing the adhesion and a block composed of a polymer component compatible with the resin for release preferably in the adhesive function layer.

The construction and material used for the electrophotographic light-sensitive element according to the present invention are not particularly limited and any of those conventionally known can be employed.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), and Hiroshi Kokado, *Kagaku to Kogyo*, Vol. 39, No. 3, p. 161 (1986), *Saikin no Kododen Zairyo to Kankotai no Kaihatsu·Jitsuyoka*, Nippon Kagaku Joho (1986), Denshishashin Gakkai (ed), *Denshishashin Gijutsu no Kiso to Oyo*, Corona (1988), and Denshishashin Gakkai (ed.), *Denshishashinyo Yukikankotai no Genjo Symposium* (preprint) (1985).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a stratified structure.

The photoconductive compounds used in the present invention may be inorganic compounds or organic compounds.

Inorganic photoconductive compounds used in the present invention include those conventionally known, for example, zinc oxide, titanium oxide, zinc sulfide, cadmium sulfide, selenium, selenium-tellurium, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent, and a binder resin or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole derivatives, imidazole derivatives, polyarylalkane derivatives, pyrazoline derivatives, pyrazolone derivatives, phenylenediamine derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers such as polyvinylpyrene, polyvinylanthracene, poly-2-vinyl-4-(4'-dimethylaminophenyl)-5-phenyloxazole and poly-3-vinyl-N-ethylcarbazole, polymers such as polyacenaphthylene, polyindene and an acenaphthylenestyrene copolymer, triphenylmethane polymers, and condensed resins such as pyrene-formaldehyde resin, bromopyreneformaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed for image exposure.

The organic pigments used include azo pigments (including monoazo, bisazo, and trisazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Suitable examples of the binder resin used are described, for example, in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C. M. C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu·Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$) and containing an acidic group such as a carboxy group, a sulfo group or a phosphono group. Suitable examples of such a resin are described, for example, in JP-A-64-70761, JP-A-2-67563, JP-A-3-181948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin*, Vol. 12, p. 9 (1973), *Yuki Gosei Kagaku*, Vol. 24, No. 11, p. 1010 (1966), Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, pp. 78 and 188 (1963), Tadaaki Tani, *Nihon Shashin Gakkaishi*, Vol. 35, p. 208 (1972), *Research Disclosure*, No. 216, pp. 117–118 (1982), and F. M. Hamer, *The Cyanine Dyes and Related Compounds*, in addition to the literature references mentioned with respect to the electrophotographic light-sensitive element above.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu·Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 $\mu$m, and preferably from 10 to 50 $\mu$m.

Where a photoconductive layer functions as a charge generating layer of a stratified type light-sensitive element composed of a charge generating layer and a charge transporting layer, the charge generating layer has a thickness of from 0.01 to 5 $\mu$m, and preferably from 0.05 to 2 $\mu$m.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

Now, the formation of toner image on the electrophotographic light-sensitive element whose surface has the releasability will be described in detail below.

For the formation of toner image, a conventional electrophotographic process can be utilized. Specifically, each step of charging, light exposure and development is performed in a conventionally known manner as described, for example, in *Denshishashin Gijutsu no Kiso to Oyo* and *Electrophotography*, supra.

The liquid developer which can be used in the present invention is characterized by containing as a binder resin constituting the toner image (i.e., fixing component), at least one resin (A) having a glass transition point of from 20° C. to 80° C. or a softening point of from 35° C. to 100° C. and at least one resin (B) having a glass transition point or a softening point at least 2° C. lower than that of the resin (A) in order to form the toner image according to the embodiment as described above. The resin (A) preferably has a glass transition point of from 23° C. to 60° C. or a softening point of from 38° C. to 80° C. The glass transition point or softening point of the resin (B) is preferably lower than that of the resin (A) in a range of from 10° C. to 80° C.

When the resin (A) and the resin (B) are contained in the same resin grain (hereinafter specifically referred to as resin grain (PLW) sometimes), the resin (A) and the resin (B) may be present in the state of admixture or may form a layered structure such as a core/shell structure composed of a portion mainly comprising the resin (A) and a portion mainly comprising the resin (B) in the resin grain (PLW). In case of core/shell structure, the resin constituting the core portion is not particularly limited and may be the resin (A) or the resin (B).

Also, when the toner image has the stratified structure, the resin (A) contained in the first image layer ($G_1$) and the resin (B) contained in the second image layer ($G_2$) meet the thermal properties of the resin (A) and the resin (B) described above, respectively.

The resins (A) and/or the resins (B) may be employed either individually or in combination of two or more thereof. The difference in the glass transition point or softening point between the resin (A) and the resin (B) used in the toner image means a difference between the lowest glass transition point or softening point of those of the resins (A) and the highest glass transition point or softening point of those of the resins (B) when two or more of the resins (A) and/or resins (B) are employed.

The content of the resin (A) having the highest glass transition point or softening point present in the first image layer ($G_1$) is preferably not less than 40% by weight, more preferably not less than 50% by weight, and the content of the resin (B) having the lowest glass transition point or softening point present in the second layer ($G_2$) is preferably not less than 30% by weight, and more preferably not less than 50% by weight.

A weight average molecular weight of each of the resin (A) and resin (B) is preferably from $3\times10^3$ to $1\times10^6$, more preferably from $1\times10^4$ to $8\times10^5$. In such a range of the molecular weight, the sufficient interaction of polymer chain occurs between each resin and thus, not only good transferability but also mechanical strength of toner image are achieved. As a result, the resulting offset printing plate does not cause a problem such as cutting of image and has good printing durability.

The resin (A) and the resin (B) used in the toner image according to the present invention are not particularly limited as far as they fulfill the above described thermal properties respectively, and include thermoplastic resins and resins conventionally known as adhesive or stick. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, polycarbonate resins, ketone resins, polyester resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins.

Specific examples of resins are descried, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa polyester Jushi Handbook*, Nikkan Kogyo Shinbunsha (1989), Kobunshi Gakkai (ed.), *Kobunshi Data Handbook* (*Oyo-hen*), Ch. 1, Baifukan (1986), Yuji Harasaki, *Saishin Binder Gijutsu Binran*, Ch. 2, Sogo Gijutsu Center (1985), Taira Okuda (ed.), *Kobunshi Kako*, Vol. 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

The resin (A) used in the toner image of the present invention may further contain a polymer component (F) containing a moiety having a fluorine atom and/or a silicon atom which is effective to increase the peelability of the resin (A) itself. Using such a resin, releasability of the toner image from the surface of electrophotographic light-sensitive element is increased and as a result, the transferability is improved.

The content of polymer component (F) is preferably for 3 to 40% by weight, more preferably from 5 to 25% by weight based on the total polymer component in the resin (A). The moiety having a fluorine atom and/or a silicon atom contained in the resin (A) includes that incorporated into the main chain of the polymer and that contained as a substituent in the side chain of the polymer. The polymer components (F) are preferably present as a block in the resin (A).

With respect to the block polymer component containing a fluorine atom and/or a silicon atom included in the resin (A), reference can be made to JP-A-6-289733.

The resin (A) and resin (B) are preferably present in the toner image in a weight ratio of resin (A)/resin (B) ranging from 5/95 to 90/10, particularly from 20/80 to 70/30. In the above described range of weight ratio of resin (A)/resin (B), the excellent transfer of toner image is achieved and the sufficient strength of toner image on the resulting offset printing plate is maintained to provide good printing durability.

The total thickness of toner image is from 0.3 to 10 $\mu$m, preferably from 0.8 to 5 $\mu$m. When the toner image has a stratified structure, a thickness ratio of the first image layer ($G_1$)/second image layer ($G_2$) is preferably from 10/90 to 85/15, more preferably from 40/60 to 80/20. The excellent transferability and printing durability are effectively obtained in the range described above.

In the liquid developers according to the present invention, components other than the resin grains (PLW) containing both the resin (A) and the resin (B), or resin grains containing the resin (A) and resin grains containing the resin (B) employed in case of forming the toner image of stratified structure are those conventionally known liquid developer for electrostatic photography can be employed. For example, specific examples of the developer are described in *Denshishashin Gijutsu no Kiso to Oyo*, supra, pp. 497–505, Koichi Nakamura (supervised), *Toner Zairyo no Kaihatsu·Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo·Teichaku·Taidene·Tensha", Gakkai Shuppan Center.

The typical liquid developer is basically composed of an electrically insulating organic solvent having an electric resistance of not less than $10^8$ Ω·cm and a dielectric constant of not more than 3.5, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein the toner grains according to the present invention and a resin for imparting dispersion stability, and chargeability to the developer.

If desired, the liquid developer can contain various additives for enhancing charging characteristics or improving image characteristics. Specifically, electroscopic materials and other additives as described, for example, in *Saishinno Denshishashin Genzo System to Toner Zairyo no Kaihatsu·Jitsuyoka*, pp. 139 to 148, Nippon Kagaku Joho (1985), Denshishashin Gakkai (ed.), *Denshishashin Gilutsu no Kiso to Oyo*, pp. 497 to 505, Corona Sha (1988), and Yuji Harasaki, *Denshishashin*, Vol. 16, No. 2, p. 44 (1977) are illustrated.

Also, di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, and carboxy group-containing methacrylate copolymers as described, for example, in British Patents 893,429 and 934,038, U.S. Pat. Nos. 1,122,397, 3,900,412 and 4,606,989, JP-A-60-179751, JP-A-60-185963 and JP-A-2-13965 are also employed.

Furthermore, other additives may be added to the liquid developer in order to maintain dispersion stability and charging stability of grains. Suitable examples of such additives include resin, petroleum resins, higher alcohols, polyethers, silicone oil, paraffin wax and triazine derivatives.

Moreover, in order to inspect the image formed by development, a colorant is preferably employed in the liquid developer. Specifically, a dispersion of an inorganic or organic pigment is used together with the resin grains, or the resin grains colored by containing a pigment or a dye is employed.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

With respect to the content of each of the main components of the liquid developer, the toner grains mainly composed of the resins (A) and/or (B) (and, if desired, a colorant) are preferably present in an amount of from 0.5 to 50 parts by weight per 1,000 parts by weight of a carrier liquid. If the toner content is less than 0.5 part by weight, the image density is insufficient, and if it exceeds 50 parts by weight, the occurrence of fog in the non-image portion may be tended to.

If desired, the above-described resin for dispersion stabilization which is soluble in the carrier liquid is added in an amount of from about 0.5 to about 100 parts by weight per 1,000 parts by weight of the carrier liquid. The above-described charge control agent can be preferably added in an amount of from 0.001 to 1.0 part by weight per 1,000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner grains has an electrical resistivity of not less than $10^8$ Ω·cm. If the resistivity is less than $10^8$ Ω·cm, a continuous gradation image of good quality can hardly be obtained.

An average grain diameter of the toner grain is preferably from 0.05 to 5 μm, more preferably from 0.1 to 1.0 μm.

The resin grains used in the liquid developer can be produced by a conventionally known mechanical powdering method or polymerization granulation method.

The mechanical powdering method includes a method wherein materials for resin grain are mixed, molten, kneaded, pulverized using a conventionally known pulverizer (for example, a ball mill, a paint shaker, and a jet mill), and then dispersed together with a dispersion polymer in a wet type dispersion machine (for example, a ball mill, a paint shaker, a Keddy mill, and a Dyno-mill), and a method wherein a material for resin grain and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in Soichi Muroi (supervised), *Chobiryushi Polymer no Saishin Gijutsu*, Ch. 2, C. M. C. (1991), Koichi Nakamura (ed.), *Saikin no Denshishashin Genzo System to Toner Zairyo no Kaihatsu·Jitsuyoka*, Ch. 3, Nippon Kogaku Joho (1985), and K. E. J. Barrett, *Dispersion Polymerization in Organic Media*, John Wiley & Sons (1975).

The resin grains composed of a random copolymer containing the polymer component (F) to increase the peelability of the resin grains can be easily obtained by performing a polymerization reaction using one or more monomers forming the resin grains which are soluble in an organic solvent but becomes insoluble therein by being polymerized together with a monomer corresponding to the polymer component (F) according to the polymerization granulation method described above.

The resin grains containing the polymer component (F) as a block can be prepared by conducting a polymerization reaction using, as a dispersion stabilizing resins, a block copolymer containing the polymer component (F) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (F) as the main repeating unit together with one or more monomers forming the resin grains. Alternatively, the resin grains composed of block copolymer can be obtained by conducting a polymerization reaction using a polymer initiator (for example, azobis polymer initiator or peroxide polymer initiator) containing the polymer component (F) as the main repeating unit.

The resin grains (PLW) containing at least two kinds of resins having different glass transition points or softening points from each other therein described above can be prepared easily using the seed polymerization method. Specifically, fine grains composed of the first resin (i.e., resin (A) or resin (B)) are prepared by a conventionally known dispersion polymerization method in a non-aqueous system and then using these fine grains as seeds, a monomer corresponding to the second resin (i.e., resin (B) or resin (A)) is supplied to conduct polymerization in the same manner as above.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, anisole, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the non-aqueous solvent used should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters.

The resin grains dispersed in the non-aqueous system are employed as the toner grains in the liquid developer containing the dispersion medium having an electric resistance of not less than $10^8$ Ω·cm and a dielectric constant of not more than 3.5 described above.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersion medium is substituted with the insulating solvent to prepare the desired dispersion.

In order to obtain colored resin grains, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process since the process is particularly suitable to form highly accurate images.

One specific example of the methods for preparing a toner image is illustrated below. An electrophotographic light-sensitive element having the release surface is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seg., Corona Sha (1988). A corotron or scotron system is usually used for the charging process. In a preferred charging process, the charging conditions may be controlled by a feedback system of the information on charged potential from a detector connected to the electrophotographic light-sensitive element thereby to control the surface potential within a predetermined range.

Thereafter, the charged electrophotographic light-sensitive element is exposed to light by scanning with a laser beam in accordance with the system described, for example, in *ibidem*, p. 254 et seg.

Toner development is then conducted using the liquid developer. The electrophotographic light-sensitive element charged and exposed is removed from the flat bed and developed according to a wet type developing method as described, for example, in *ibidem*, p. 275 et seg. The exposure mode is determined in accordance with the toner image development mode. Specifically, in case of reversal development, a negative image is irradiated with a laser beam, and a toner having the same charge polarity as that of the charged electrophotographic light-sensitive element is electrodeposited on the exposed area with a bias voltage applied. For the details, reference can be made to *ibidem*, p. 157 et seg.

After the toner development, the electrophotographic light-sensitive element is squeegeed to remove the excess developer using a rubber roller, a gap roller or a reverse roller as described in *ibidem*, p. 283, or by corona squeegee or air squeegee.

Preferably, the electrophotographic light-sensitive element is rinsed with the carrier liquid alone used in the liquid developer before squeegee.

According to the preferred embodiment of the present invention, as described above, after the formation of first image layer ($G_1$) on the release surface of electrophotographic light-sensitive element, the second image layer ($G_2$) is selectively provided only on the first image layer ($G_1$), and then the resulting toner image composed of the first image layer ($G_1$) and the second image layer ($G_2$) is collectively transferred to the intermediate transfer medium of the present invention.

By providing on the first image layer mainly composed of the resin (A), the second image layer mainly composed of the resin (B) which has a glass transition point or softening point lower than one of the resin (A), the second image layer advantageously works to adhesion to the intermediate transfer medium. As a result, when an original of a high image area ratio is used or when a transfer speed is increased, excellent transferability of toner image is maintained, and fine lines (e.g., lines of 10 μm in width), fine letters (e.g., 2.2 point size of Ming-zhao character) and dots (e.g., a range of from 2% to 98% in dots of 165 lines per inch) are faithfully reproduced without the occurrence of spread of image and distortion of image, whereby the excellent transferred image is formed on the receiving material.

In order to provide the second image layer ($G_2$) only on the first image layer ($G_1$), electrophoretic migration of resin grains is essentially employed. Specifically, there are a method for forming the second image layer ($G_2$) in the same manner as in the liquid development in the electrophotographic process and a wet type electrodeposition method wherein the resin grains are selectively migrated by electrophoresis only on the first image layer ($G_1$) utilizing the residual electric charge remaining after the formation of the first image layer ($G_1$) thereby forming the second image layer ($G_2$). These methods are suitable for easily forming the second image layer ($G_2$) of a uniform and small thickness only on the first image layer ($G_1$).

For the purpose of forming the second image layer ($G_2$) selectively on the first image layer ($G_1$), a difference in a potential of electric charge due to whether the toner image is present or not can be utilized. Specifically, when the electrophotographic light-sensitive element having the first image layer ($G_1$) formed thereon is electrically charged, the image portion has a higher electric charge in comparison with other portions. The charging is preferably conducted using a non-contact type corona discharger such as corotron or scotron. A bias voltage of more than the electric potential of non-image portion but less than that of first image layer ($G_1$) is applied to a development electrode during the formation of second image layer ($G_2$), whereby the adhesive layer is selectively formed on the first image layer ($G_1$).

Alternatively, the second image layer ($G_2$) is selectively formed on the first image layer ($G_1$) by conducting the charging and exposure in the same manner as in the formation of first image layer ($G_1$) and then a wet type electrodeposition method based on electrophoresis using a non-aqueous dispersion of grains of the resin (B) in place of the liquid developer described above.

The formation of grains of Resin (B) and preparation of dispersion of electroscopic resin grains are performed in the same manner as in the electrodeposition method of the resin (A) described above.

It is preferred that the toner grains mainly composed of the resin (B) used for the formation of second image layer ($G_2$) do not contain a colorant to well retain the effect of improved adhesion.

The toner image thus-formed on the electrophotographic light-sensitive element is dried to remove the dispersion medium (i.e., solvent) contained therein by evaporation before the contact transfer of toner image onto the intermediate transfer medium. The dispersion medium (i.e., solvent) adhered on the surface of electrophotographic light-sensitive element which has not been removed by squeegee is also eliminated at the same time. Thus, the amount of dispersion medium (i.e., solvent) on the electrophotographic light-sensitive element is substantially zero.

For such a purpose, various methods, for example, blotting by a blotter, blowing of cool or hot air, using radiant heat such as an infrared ray or xenon flash and heating from the near side of electrophotographic light-sensitive element can be utilized individually or as a combination of two or more thereof. Specifically, the method for fixing as described in *ibidem*, p. 317 et seg. is employed.

By the drying step, adhesion between toner grains increases in the toner image and a state wherein the cohesive force in the toner image is greater than the adhesion force between the toner image and the surface of electrophotographic light-sensitive element is formed. A means for drying the solvent, a means for heating the toner image to perform fixing optionally provided and the conditions thereof can be varied depending on the kinds of liquid developer and squeegee means employed and appropriately selected.

The temperature of the surface of electrophotographic element is advantageously controlled nearly equal to the temperature ($T_1$) used at the succeeding transfer step. It is preferably adjusted in a range of from 35° C. to 70° C., more preferably in a range of from 40° C. to 65° C.

The toner image on the surface of electrophotographic light-sensitive element is then contact-transferred onto the intermediate transfer medium having an adhesive surface and then onto a final receiving material acting as a support for a lithographic printing plate.

The intermediate transfer medium used in the contact transfer method according to the present invention has a function of receiving the toner image formed on the electrophotographic light-sensitive element under a condition of applying heat and/or pressure (first transfer) and then releasing and transferring the toner image to a final receiving material (i.e., a support for a lithographic printing plate under a condition of applying heat and/or pressure (second transfer).

In the method of the present invention, the surface temperature ($T_1$) of the intermediate transfer medium at the first transfer is different from the surface temperature ($T_2$) thereof at the second transfer and the latter is adjusted higher than the former. The difference in temperature is preferably from 10° C. to 80° C., more preferably from 20° C. to 60° C. The surface temperature ($T_1$) at the first transfer is preferably in a range of from 35° C. to 70° C., more preferably in a range of from 40° C. to 65° C. On the other hand, the surface temperature ($T_2$) at the second transfer is preferably in a range of from 45° C. to 120° C., more preferably in a range of from 50° C. to 95° C.

The intermediate transfer medium used in the present invention is characterized by having a surface adhesion force of not less than 3 gram·force at the temperature ($T_1$) for first transfer and not more than 40 gram·force at the temperature ($T_2$) for second transfer as described above.

By making a discrimination in the temperature between the first transfer and the second transfer and controlling the surface adhesion force of intermediate transfer medium, the complete transfer of toner image from the electrophotographic light-sensitive element to the intermediate transfer medium and from the intermediate transfer medium to a final receiving material can be achieved.

The contact transfer of toner image under applying heat and/or pressure can be conducted using known procedures and devices. For instance, the electrophotographic light-sensitive element having the toner image is brought into intimate contact with the intermediate transfer medium and they are passed between rollers under heating to transfer the toner image on the intermediate transfer medium. Similarly, the toner image is transferred to a final receiving material by bringing the intermediate transfer medium into intimate contact with the final receiving material and passing them between rollers under heating.

In order to control the surface temperature at the first transfer and the second transfer in the ranges described above, conventionally known methods can be employed. For example, the heating means as described in the drying step of toner image hereinbefore are suitably employed.

The nip pressure of roller is preferably in a range of from 0.2 to 15 kgf/cm$^2$ and more preferably from 0.5 to 8 kgf/cm$^2$. The roller may be pressed by springs provided on opposite ends of the roller shaft or by an air cylinder using compressed air. A speed of the transportation is preferably in a range of from 10 to 300 mm/sec and more preferably in a range of from 20 to 250 mm/sec. The speed of transportation may differ between the electrophotographic process and the contact transfer step. Also, the transportation speed of first transfer may be different from that of second transfer.

Any intermediate transfer media can be employed as far as the above described conditions are fulfilled. For example, intermediate transfer media of drum type and of endless belt type which are repeatedly usable are illustrated. In the intermediate transfer medium of drum type, an elastic material layer and an adhesive resin layer are preferably provided in order on the drum as described hereinafter.

Conventionally known materials can be used as materials for the intermediate transfer medium of endless belt type. For example, those described in U.S. Pat. Nos. 3,893,761, 4,684,238 and 4,690,539 are employed. Further, a layer serving as a heating medium may be provided in the belt as described in JP-W-4-503265 (the term "JP-W" as used herein means an "unexamined published international patent application").

The surface of intermediate transfer medium fulfills the above described physical properties and comprises a cured layer of adhesive or stick which exhibits the adhesion on the low temperature side and the releasability on the high temperature side (hereinafter referred to as an adhesive resin layer sometimes). Specific examples of the adhesive resin layer include cured layers formed from materials called adhesive of re-releasable type or pressure-sensitive adhesive of re-releasable type mainly composed of an acrylic ester copolymer, methacrylic ester copolymer or vinyl other copolymer.

Preferably, adhesive composition mainly composed of a (meth)acrylate resin as described, for example, in JP-A-52-91041, JP-A-58-104974 and JP-A-58-141271 and adhesive composition mainly composed of a silyl-modified polyether resin as described, for example, in JP-A-4-36368.

The adhesive resin layer is preferably cured by photo- and/or heat-treatment. For curing, any conventionally known methods can be employed. Specific methods are same as those described for the overcoat layer of the electrophotographic light-sensitive element. A thickness of the adhesive resin layer is preferably from 0.05 $\mu$m to 1 mm, more preferably from 0.1 to 100 $\mu$m.

By using the adhesive resin layer as described above, the toner image is transferred rapidly and completely without raising a heating temperature at the contact transfer, and durability of the intermediate transfer medium to repeated use is also maintained.

It is preferred that the intermediate transfer medium of the present invention has an elastic material layer having a thickness greater than the thickness of toner image to be transferred under the adhesive resin layer. The thickness of elastic material layer is preferably from 0.01 to 10 mm, more preferably from 0.05 to 5 mm. Since the elastic material layer acts to relieve the pressure applied to the toner image due to its cushioning effect during the contact transfer with heat and pressure, faithful transfer of highly accurate toner image can be made without disorder such as twist or distortion of the image.

The elastic material layer may be an elastic material layer composed of a resin having elasticity or have a stratified structure of the elastic material layer and a reinforcing layer.

Any conventionally known natural resins and synthetic resins can be used as the elastic material. These resins may be used either individually or as a combination of two or more thereof in a single or plural layer. Specifically, various resins described, for example, in A. D. Roberts, *Natural Rubber Science and Technology*, Oxford Science Publications (1988), W. Hofmann, *Rubber Technology Handbook*, Hanser Publisher (1989) and *Plastic Zairyo Koza*, Vols. 1 to 18, Nikkan Kogyo Shinbunsha can be employed.

Specific examples of the elastic material include styrene-butadiene rubber, butadiene rubber, acrylonitrile-butadiene rubber, cyclized rubber, chloroprene rubber, ethylene-propylene rubber, butyl rubber, chloro-sulfonated polyethylene rubber, silicone rubber, fluoro-rubber, polysulfide rubber, natural rubber, isoprene rubber and urethane rubber. The desired elastic material can be appropriately selected taking durability into consideration.

Examples of materials used in the reinforcing layer for the elastic material layer include cloth, glass fiber, resin-impregnated specialty paper, aluminum and stainless steel. A spongy rubber layer may be provided between the elastic material layer and the reinforcing layer.

The toner image on the intermediate transfer medium is then contact-transferred to a final receiving material.

The final receiving material used in the present invention is any materials which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis in an electrolytic solution comprising at least one aqueous or nonaqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621,478 is also effective.

The surface treatment is conducted not only for rendering the surface of receiving material hydrophilic, but also for increasing adhesion of the toner image transferred to the receiving material.

Further, in order to control an adhesion property between the receiving material and the toner image, a surface layer may be provided on the surface of the receiving material.

A plastic sheet or paper as the receiving material should have a hydrophilic surface layer, as a matter of course, since its areas other than those corresponding to the toner images must be hydrophilic. Specifically, a receiving material having the same performance as a known direct drawing type lithographic printing plate precursor or an image-receptive layer thereof may be employed.

The contact transfer of toner image from the intermediate transfer medium to the final receiving material can be performed using a known procedure and device.

Preferred ranges of a nip pressure between the intermediate transfer medium and the final receiving material and a transportation speed are same as those described for the contact transfer of toner image from the electrophotographic light-sensitive element to the intermediate transfer medium hereinbefore. These conditions may be the same or different in the first transfer step and the second transfer step.

Further, a cooling means is provided in a backup roller for release in order to sufficiently make sure of rapid and stable transfer to the receiving material depending on the kind of liquid developer or receiving material. It is believed that tackiness of the toner image increases owing to heating by a heating means of the intermediate transfer medium and the toner image adheres to the receiving material. After the toner image passed under the backup roller for release, for example, a cooling roller, the temperature of toner image decreases to reduce its flowability and tackiness and thus the toner image is completely released from the surface of intermediate transfer medium in a stable manner.

The cooling roller comprises a metal roller which has a good thermal conductivity such as aluminum, copper or the like and is covered with silicone rubber. It is preferred that the cooling roller is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

In the method of the present invention, the transfer of toner image from the electrophotographic light-sensitive element to the intermediate transfer medium and the transfer of toner image from the intermediate transfer medium to the final receiving material may be simultaneously performed within one sheet. Alternatively, after the transfer of the whole image of one sheet from the electrophotographic light-sensitive element to the intermediate transfer medium has been completed, the toner image is then transferred to the final receiving material.

It is needless to say that the above-described conditions for the transfer of toner image should be optimized depending on the physical properties of the electrophotographic light-sensitive element (i.e., the light-sensitive layer and the support), the toner image, the intermediate transfer medium and the receiving material used. Especially it is important to determine the conditions of temperature in the heat transfer step taking into account the factors such as glass transition point, softening temperature, flowability, tackiness, film properties and thickness of the surface layer of intermediate transfer medium.

Depending on the kind of liquid developer used, the toner image transferred onto the final receiving material may be subjected to a further treatment such as fixing in order to form a uniform film of the image which does not suffer damage by a mechanical force at the printing.

When the plate making is repeatedly conducted according to the present invention, dust, for example, paper dust created in a plate making machine based on a paper support used as the final receiving material adheres to the adhesive surface of intermediate transfer medium which may cause a trouble in the transfer step. In order to prevent such a trouble, a cleaning unit for removing dust adhered to the surface of intermediate transfer medium may be provided in the plate making machine.

The cleaning unit is not particularly limited as far as it can remove dust adhered to the surface of intermediate transfer medium. For example, a cleaning pad such as an adhesive tape for removing dust, or a method wherein a thermoplastic resin layer is formed on the surface of intermediate transfer medium by an appropriate method, for example, an electrodeposition coating method, a hot-melt coating method or a transfer method from release paper and then peeled off is utilized.

Now, the method for preparation of a printing plate using an electrophotographic process according to the present invention will be described in more detail as well as apparatus useful therefor with reference to the accompanying drawings hereinbelow.

Figure 2:
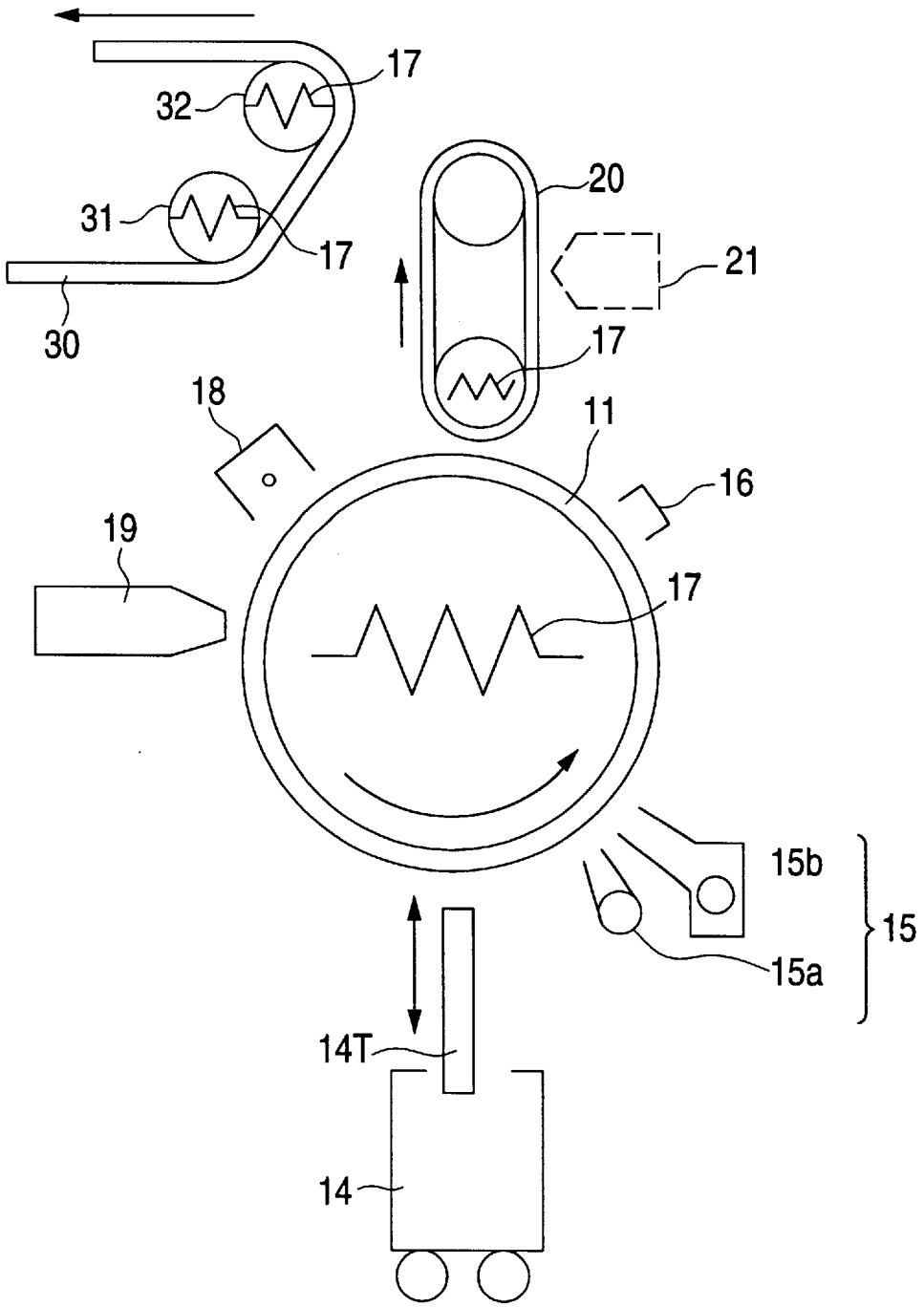
FIG. 2 is a schematic view of an apparatus for preparation of a printing plate by an electrophotographic process suitable for performing the method according to the present invention in which a primary receptor of an endless belt type is used.
Figure 3:
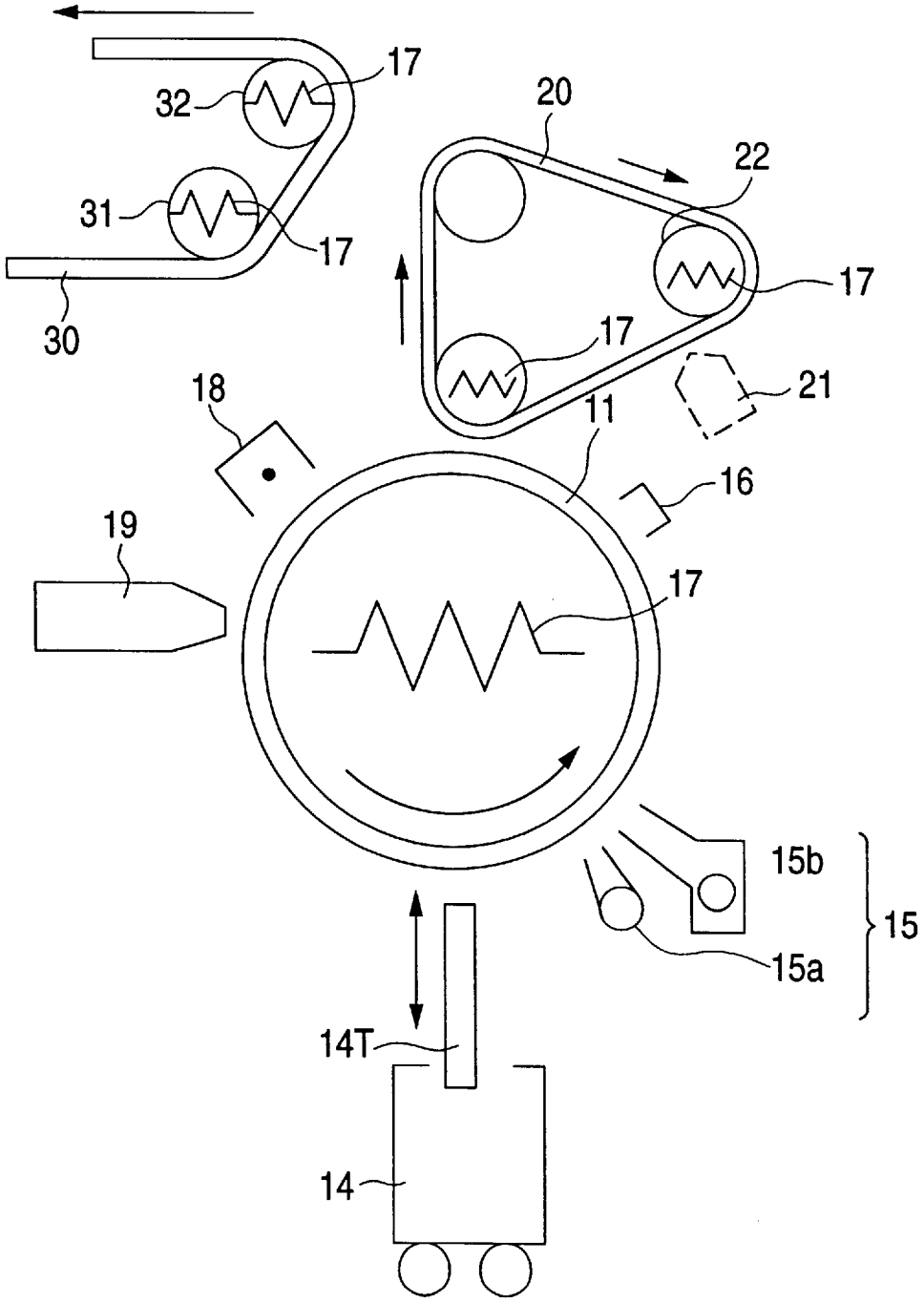
FIG. 3 is a schematic view of an apparatus for preparation of a printing plate by an electrophotographic process suitable for performing the method according to the present invention in which a primary receptor of another endless belt type is used.

FIGS. 1 to 3 each is a schematic view of an apparatus for preparation of a printing plate by an electrophotographic process suitable for conducting the method according to the present invention. An intermediate transfer medium of a drum type is employed in FIG. 1, while intermediate transfer media of an endless type are used in FIGS. 2 and 3.

In FIG. 1, an electrophotographic light-sensitive element 11 is uniformly charged to, for instance, a positive polarity by a corona charger 18 and then is exposed imagewise by an exposure device (e.g., a semi-conductor laser) 19 on the basis of image information, whereby an electric potential is lowered in the exposed regions and thus, a contrast in the electrical potential is formed between the exposed regions and the unexposed regions. A toner image forming unit 14T containing a liquid developer comprising resin grains having a positive electrostatic charge dispersed in an electrically insulating dispersion medium is brought near the surface of electrophotographic light-sensitive element 11 from a liquid developing unit set 14 and is kept stationary with a gap of 1 mm therebetween.

The electrophotographic light-sensitive element 11 is first pre-bathed by a pre-bathing means provided in the toner image forming unit, and then the liquid developer is supplied on the surface of electrophotographic light-sensitive element while applying a developing bias voltage between the electrophotographic light-sensitive element and a development electrode by a bias voltage source and wiring (not shown). The bias voltage is applied so that it is slightly lower than the surface electrical potential of the unexposed regions, while the development electrode is charged to positive and the electrophotographic light-sensitive element is charged to negative. When the bias voltage applied is too low, a sufficient density of the toner image cannot be obtained.

The liquid developer adhering to the surface of electrophotographic light-sensitive element is subsequently washed off by a rinsing means provided in the liquid developing unit set 14 and the rinse solution adhering to the surface of electrophotographic light-sensitive element is removed by a squeegee means. Then, the electrophotographic light-sensitive element is dried by passing under a suction/exhaust unit 15. Meanwhile an intermediate transfer medium is kept away from the surface of electrophotographic light-sensitive element. As a pre-bath solution and a rinse solution, a carrier liquid for a conventional liquid developer is usually employed.

According to a preferred embodiment of the present invention, after heating the electrophotographic light-sensitive element by a heating means 16 to control its surface temperature at the desired range, the charging and imagewise exposure are conducted as described above and then the development and rinsing are carried out using a liquid developer and rinse solution adjusted at the same temperature as above respectively.

The temperature for conducting the electrophotographic process with pre-heating is preferably in a range of from 35° C. to 70° C., more preferably from 40° C. to 65° C. In such a range, the formation of a duplicated image faithful to the original is performed in a stable manner. In case of the formation of the toner image of a stratified structure, the above-described steps are repeated.

The toner image formed on the electrophotographic light-sensitive element 11 is then contact-transferred onto the intermediate transfer medium 20 at the temperature ($T_1$). Specifically, after the electrophotographic light-sensitive element 11 is pre-heated in the desired range of temperature by the heating means 16, if desired, and the intermediate transfer medium 20 is also pre-heated in the desired range of temperature by the heating means 16, if desired, the toner image on the electrophotographic light-sensitive element is brought into contact with the intermediate transfer medium under a pressure, whereby the toner image is transferred onto the intermediate transfer medium 20.

A cleaning unit 21 and a cooling part 22 as shown in FIG. 3 may be provided. The cooling part 22 is installed in order to rapidly conduct the temperature control from the temperature ($T_1$) to the temperature ($T_2$).

The toner image on the intermediate transfer medium 20 is then contact-transferred onto a final receiving material 30 at the temperature ($T_2$). Specifically, after the intermediate transfer medium 20 is heated in the desired range of temperature by the heating means 16, and the final receiving material 30 is also pre-heated in the desired range of temperature by a backup roller for transfer 31, if desired, the toner image on the intermediate transfer medium is brought into contact with the final receiving material under a pressure, and if desired, cooled by a backup roller for release 32, whereby the toner image is transferred onto the final receiving material 30. Thus, a cycle of the steps is terminated.

In accordance with the method of the present invention, a toner image formed from a liquid developer on an electrophotographic light-sensitive element is transferred with good efficiency onto a final receiving material through an intermediate transfer medium, and the electrophotographic light-sensitive element and intermediate transfer medium are well durable to repeated used. Further, a lithographic printing plate obtained provides a large number of prints having highly accurate images free from background stain.

The present invention is illustrated in greater detail with reference to the following examples, but the present invention is not to be construed as being limited thereto.

SYNTHESIS EXAMPLE 1 OF RESIN GRAIN (PL): (PL-1)

A mixed solution of 10 g of Dispersion Stabilizing Resin (Q-1) having the structure shown below, 80 g of vinyl acetate, 20 g of vinyl propionate, and 384 g of Isopar H was heated to a temperature of 75° C. under nitrogen gas stream while stirring.

Dispersion Stabilizing Resin (Q-1)

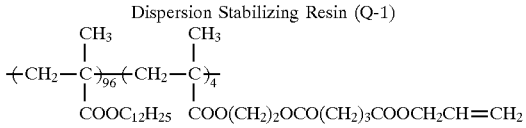

Mw 4.5 x $10^4$ (weight ratio)

To the solution was added 1.5 g of 2,2'-azobis-(isovaleronitrile) (abbreviated as AIVN) as a polymerization initiator, followed by reacting for 3 hours. Twenty minutes after the addition of the polymerization initiator, the reaction mixture became white turbid, and the reaction temperature rose to 88° C. Then, 0.8 g of the above-described initiator was added to the reaction mixture, the reaction were carried out for 2 hours. The temperature of reaction mixture was raised to 100° C. and stirred for 2 hours to remove the unreacted vinyl monomer by distillation. After cooling, the reaction mixture was passed through a nylon cloth of 200 mesh to obtain a white dispersion which was a latex of good monodispersity with a polymerization rate of 93% and an average grain diameter of 0.23 $\mu$m. the grain diameter was measured by CAPA-500 manufactured by Horiba Ltd. (hereinafter the same).

A part of the above-described white dispersion was centrifuged at a rotation of $1.5\times10^4$ r.p.m. for 60 minutes and the resin grains precipitated were collected and dried. A weight average molecular weight (Mw) of the resin grain measured by a GPC method and calculated in terms of polystyrene (hereinafter the same) was $9\times10^4$. A glass transition point (Tg) thereof was 31° C.

SYNTHESIS EXAMPLES 2 TO 4 OF RESIN GRAIN (PL): (PL-2) TO (PL-4)

Each of the resin grains (PL) was synthesized in the same manner as in Synthesis Example 1 of Resin Grain (PL) except for using each of the monomers shown in Table A below in place of 80 g of vinyl acetate and 20 g of vinyl propionate employed in Synthesis Example 1 of Resin Grain (PL).

A polymerization rate of each of the resin grains was in a range of from 90% to 95% and an average grain diameter thereof was in a range of from 0.20 $\mu$m to 0.25 $\mu$m with good monodispersity. An Mw of each of the resin grains was in a range of from $2\times10^5$ to $4\times10^5$.

TABLE A

| Synthesis Example of Resin Grain (PL) | Resin Grain (PL) | Monomer | Amount (g) | Tg of Resin Grain (°C.) |
|---|---|---|---|---|
| 2 | PL-2 | Vinyl acetate | 100 | 38 |
| 3 | PL-3 | Vinyl acetate | 90 | 35 |
| | | Vinyl propionate | 10 | |
| 4 | PL-4 | Vinyl acetate | 75 | 21 |
| | | Vinyl butyrate | 25 | |

SYNTHESIS EXAMPLE 5 OF RESIN GRAIN (PL): (PL-5)

A mixed solution of 12 g of Dispersion Stabilizing Resin (Q-2) having the structure shown below and 680 g of Isopar G was heated to a temperature of 60° C. under nitrogen gas stream while stirring.

Dispersion Stabilizing Resin(Q-2)

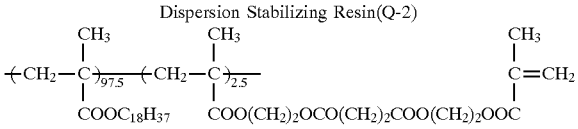

Mw 5 x $10^4$ (weight ratio)

To the solution was added dropwise a mixture of 40 g of ethyl methacrylate, 60 g of methyl acrylate and 1.0 g of AIVN over a period of one hour, followed by reacting for two hours. To the reaction mixture was further added 0.8 g of AIVN, followed by reacting for 2 hours. Then, 0.5 g of 2,2'-azobis(isobutyronitrile) (abbreviated as AIBN) was added thereto and the temperature was adjusted to 80° C., and the reaction was continued for 2 hours. To the reaction mixture was further added 0.5 g of AIBN, followed by reacting for 2 hours. The temperature of reaction mixture was raised to 100° C. and the unreacted monomer was distilled off under a reduced pressure of 10 to 20 mmHg.

After cooling, the reaction mixture was passed through a nylon cloth of 200 mesh to obtain a white dispersion which was a latex of good monodispersity with a polymerization rate of 98% and an average grain diameter of 0.22 $\mu$m. An Mw of the resin grain was $3\times10^5$ and a Tg thereof was 26° C.

SYNTHESIS EXAMPLES 6 TO 12 OF RESIN GRAIN (PL): (PL-6) TO (PL-12)

Each of the resin grains (PL) was synthesized in the same manner as in Synthesis Example 5 of Resin Grain (PL) except for using each of the monomers shown in Table B below in place of 40 g of ethyl methacrylate and 60 g of methyl acrylate employed in Synthesis Example 5 of Resin Grain (PL).

A polymerization rate of each of the resin grains was in a range of from 96% to 99% and an average grain diameter thereof was in a range of from 0.15 $\mu$m to 0.25 $\mu$m with good monodispersity. An Mw of each of the resin grains was in a range of from $3\times10^5$ to $5\times10^5$.

TABLE B

| Synthesis Example of Resin Grain (PL) | Resin Grain (PL) | Monomer | Amount (g) | Tg of Resin Grain (°C.) |
|---|---|---|---|---|
| 6 | PL-6 | Methyl methacrylate | 20 | 26 |
| | | Methyl acrylate | 80 | |
| 7 | PL-7 | Ethyl methacrylate | 25 | 17 |
| | | Methyl acrylate | 75 | |
| 8 | PL-8 | Benzyl methacrylate | 60 | 34 |
| | | 2-Ethoxyethyl methacrylate | 40 | |
| 9 | PL-9 | n-Butyl methacrylate | 22 | 28 |
| | | Methyl acrylate | 30 | |
| | | Ethyl methacrylate | 48 | |
| 10 | PL-10 | Methyl methacrylate | 15 | 21 |
| | | Methyl acrylate | 85 | |
| 11 | PL-11 | n-Propyl methacrylate | 60 | 38 |
| | | Methyl acrylate | 40 | |
| 12 | PL-12 | Methyl methacrylate | 35 | 14 |
| | | Ethyl acrylate | 65 | |

SYNTHESIS EXAMPLE 13 OF RESIN GRAIN (PL): (PL-13)

A mixed solution of 5 g of Dispersion Stabilizing Resin (Q-3) having the structure shown below, 10 g of a dimethylsiloxane macromonomer (FM-0725 manufactured by Chisso Corp.) (Macromonomer (M-1)) and 520 g of Isopar H was heated to a temperature of 50° C. under nitrogen gas stream while stirring.

Dispersion Stabilizing Resin (Q-3)

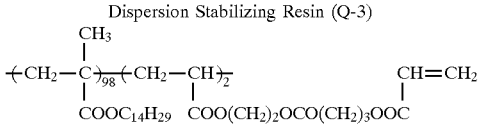

Mw 3.5 × $10^4$ (weight ratio)

To the solution was added dropwise a mixture of 30 g of methyl methacrylate, 60 g of methyl acrylate and 1.0 g of 2,2'-azobis(2-cyclopropylpropionitrile) (abbreviated as ACPP) over a period of 60 minutes, followed by reacting for 1.5 hours. To the reaction mixture was further added 0.8 g of ACPP, followed by reacting for 2 hours. Then, 0.8 g of AIBN was added thereto and the temperature was adjusted to 80° C., and the reaction was continued for 2 hours. To the reaction mixture was further added 0.8 g of AIBN, followed by reacting for 2 hours. After cooling, the reaction mixture was passed through a nylon cloth of 200 mesh to obtain a white dispersion which was a latex of good monodispersity with a polymerization rate of 99% and an average grain diameter of 0.19 μm. An Mw of the resin grain was $9\times10^4$ and a Tg thereof was 28° C.

SYNTHESIS EXAMPLES 14 AND 15 OF RESIN GRAIN (PL): (PL-14) AND (PL-15)

Each of the resin grains (PL) was synthesized in the same manner as in Synthesis Example 13 of Resin Grain (PL) except for using each of the macromonomers shown in Table C below (Mw being in a range of from $8\times10^3$ to $1\times10^4$) in place of 10 g of Macromonomer (M-1) employed in Synthesis Example 13 of Resin Grain (PL). A polymerization rate of each of the resin grains was in a range of from 98% to 99% and an average grain diameter thereof was in a range of from 0.15 μm to 0.25 μm with good monodispersity of a narrow size distribution. An Mw of each of the resin grains was in a range of from $8\times10^4$ to $1\times10^5$.

SYNTHESIS EXAMPLE 1 OF RESIN GRAIN (PLW): (PLW-1)

A mixture of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. To the reaction mixture was added 0.8 g of AIBN, followed by reacting for 2 hours. Further, 0.8 g of AIBN, followed by reacting for 2 hours. After cooling the reaction mixture was passed through a nylon cloth of 22 mesh to obtain a white dispersion which was a latex of good monodispersity with a polymerization rate of 93% and an average grain diameter of 0.18 μm.

A part of the above-described white dispersion was centrifuged at a rotation of $1\times10^4$ r.p.m. for 60 minutes and the resin grains precipitated were collected and dried. A weight average molecular weight (Mw) and a glass transition point (Tg) of the resin grain were measured. An Mw of the resin grain was $8\times10^4$ and a Tg thereof was 18° C.

The resin grain thus-obtained is designated as Resin Grain (PLR-1).

A mixed solution of the whole amount of the above-described resin grain dispersion (as seed) and 10 g of Dispersion Stabilizing Resin (Q-4) having the structure shown below was heated to a temperature of 60° C. under nitrogen gas stream with stirring. To the mixture was added dropwise a mixture of 60 g of methyl methacrylate, 40 g of methyl acrylate, 0.8 g of AIVN and 400 g of Isopar G over a period of 2 hours, followed by further reacting for 2 hours. Then 0.8 g of AIVN was added to the reaction mixture, the temperature thereof was raised to 80° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization rate of 98% and an average grain diameter of 0.25 μm.

TABLE C

| Synthesis Example of Resin Grain (PL) | Resin Grain (PL) | Macromonomer | Tg of Resin Grain (°C.) |
|---|---|---|---|
| 14 | PL-14 | (M-2) 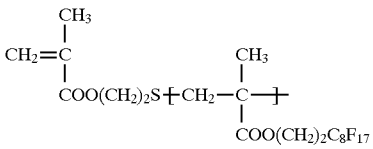 | 29 |
| 15 | PL-15 | (M-3) 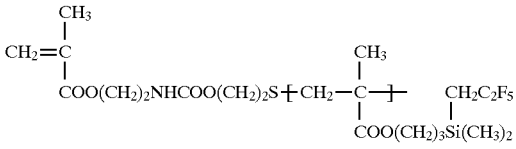 | 25 |

Dispersion Stabilizing Resin (Q-4)

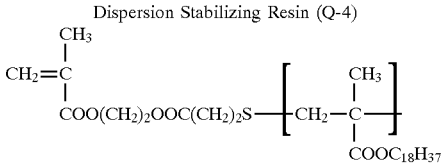

In order to investigate that the resin grain thus-obtained was composed of the two kinds of resins, the state of resin grain was observed using a scanning electron microscope (SEM).

Specifically, the dispersion of Resin Grain (PLW-1) was applied to a polyethylene terephthalate film so that the resin grains were present in a dispersive state on the film, followed by heating at a temperature of 20° C. or 50° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 20° C. On the contrary, with the sample heated at 50° C. the resin grains had been melted by heating and were not observed.

The state of resin grain was observed in the same manner as described above with respect to resin grains formed from respective two kinds of resins (copolymers) constituting Resin Grain (PLW-1), i.e., Resin Grain (PLR-1) having a Tg of 18° C. and Resin Grain (PLR-2) having a Tg of 39° C. described below, and a mixture of these resin grains in a weight ratio of 1:1.

Preparation of Resin Grain (PLR-2)

A mixed solution of 18 g of Dispersion Stabilizing Resin (Q-4) described above and 553 g of Isopar H was heated to a temperature of 55° C. under nitrogen gas stream while stirring. To the solution was added dropwise a mixture of 60 g of methyl methacrylate, 40 g of methyl acrylate and 1.0 g of ACPP over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours.

After cooling, the reaction mixture was passed through a nylon cloth of 200 mesh to obtain a white dispersion which was a latex of good monodispersity with a polymerization rate of 99% and an average grain diameter of 0.15 $\mu$m. An Mw of the resin grain was $1.5\times10^4$ and a Tg thereof was 39° C.

As a result, it was found that with Resin Grain (PLR-1), the resin grains were not observed in the sample heated at 20° C., although the resin grains were observed in the sample before heating. On the other hand, with Resin Grain (PLR-2), the resin grains were not observed in the sample heated at 50° C. Further, with the mixture of two kinds of resin grains, disappearance of the resin grains was observed in the sample heated at 20° C. in comparison with the sample before heating.

From these results it was confirmed that Resin Grain (PLW-1) described above was not a mixture of two kinds of resin grains but contained two kinds of resins therein, and had a core/shell structure wherein the resin having a relatively high Tg formed shell portion and the resin having a relatively low Tg formed core portion.

SYNTHESIS EXAMPLES 2 TO 5 OF RESIN GRAIN (PLW): (PLW-2) TO (PLW-5)

Each of Resin Grains (PLW-2) to (PLW-5) was synthesized in the same manner as in Synthesis Example 1 of Resin Grain (PLW) except for using each of the monomers shown in Table D below in place of the monomers employed in Synthesis Example 1 of Resin Grain (PLW). A polymerization ratio of each of the resin grains obtained in latexes was in a range of from 95% to 99% and an average grain diameter thereof was in a range of from 0.20 $\mu$m to 0.30 $\mu$m with good monodispersity.

TABLE D

| Synthesis Example of Resin Grain (PLW) | Resin Grain (PLW) | Monomer for Seed Grain | Amount (g) | Tg of Seed Grain (°C.) | Monomer for Feeding | Amount (g) | Tg of Resin Formed from Monomer for Feeding (%) |
|---|---|---|---|---|---|---|---|
| 2 | PLW-2 | Ethyl methacrylate | 65 | 12 | Ethyl methacrylate | 70 | 28 |
| | | Ethyl acrylate | 35 | | Methyl acrylate | 30 | |
| 3 | PLW-3 | Vinyl acetate | 100 | 38 | Ethyl methacrylate | 20 | 32 |
| | | | | | Methyl acrylate | 80 | |
| 4 | PLW-4 | Vinyl acetate | 70 | 25 | Methyl methacrylate | 30 | 34 |
| | | Vinyl propionate | 30 | | Methyl acrylate | 70 | |
| 5 | PLW-5 | Methyl methacrylate | 45 | 20 | Ethyl methacrylate | 75 | 29 |
| | | Ethyl acrylate | 55 | | Methyl methacrylate | 25 | |

SYNTHESIS EXAMPLE 6 OF RESIN GRAIN (PLW): (PLW-6)

A mixture of resins comprising a vinyl acetate/ethylene (46/54 by weight ratio) copolymer (Evaflex 45X manufactured by Du Pont-Mitsui Polychemicals Co., Ltd.) having a Tg of −25° C. and polyvinyl acetate having a Tg of 38° C. in a weight ratio of 1:2 was melted and kneaded by a three-roll mill at a temperature of 120° C. and then pulverized by a trioblender. A mixture of 5 g of the resulting coarse powder, 4 g of a dispersion stabilizing resin (Sorprene 1205 manufactured by Asahi Chemical Industry Co., Ltd.) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4,500 r.p.m. for 6 hours, and then passed through a nylon cloth of 200 mesh to obtain a white dispersion which was a latex having an average grain diameter of 0.4 $\mu$m.

SYNTHESIS EXAMPLE 1 OF COLORED RESIN GRAIN (CPL): (CPL-1)

A mixed solution of 10 g of Dispersion Stabilizing Resin (Q-1) described above, 80 g of vinyl acetate, 15 g of vinyl propionate, 5 g of crotonic acid and 384 g of Isopar H was heated to a temperature of 75° C. under nitrogen gas stream while stirring. To the solution was added 1.0 g of AIBN as a polymerization initiator, followed by reacting for 3 hours.

To the reaction mixture was further added 0.8 g of AIBN, followed by reacting for 2 hours. Then, 0.8 g of AIBN was added thereto and the temperature was adjusted to 85° C., and the reaction was continued for 3 hours.

After cooling, the reaction mixture was passed through a nylon cloth of 200 mesh to obtain a white dispersion which was a latex of good monodispersity with a polymerization rate of 94% and an average grain diameter of 0.25 μm. An Mw of the resin grain was $9\times10^4$ and a Tg thereof was 39° C.

To the white dispersion was added 5.0 g of Aizen Victoria Blue B (manufactured by Hodogaya Chemical Co., Ltd.) as a basic dye and the temperature of mixture was raised to 100° C., followed by stirring for 3 hours. After cooling, the mixture was allowed to stand for one day. Then, the mixture was passed through a nylon cloth of 200 mesh to obtain a blue dispersion which was a colored latex of good monodispersity with an average grain diameter of 0.25 μm.

SYNTHESIS EXAMPLE 2 OF COLORED RESIN GRAIN (CPL): (CPL-2)

To the whole amount of the white dispersion obtained in Synthesis Example 5 of Resin Grain (PL) was added 5.0 g of Sumikalon Navy Blue R (manufactured by Sumitomo Chemical Co., Ltd.) as a disperse dye and the mixture was stirred for 4 hours at 100° C. after cooling, the mixture was allowed to stand for one day. Then, the mixture was passed through a nylon cloth of 200 mesh to obtain a blue dispersion which was a colored latex of good monodispersity with an average grain diameter of 0.23 μm.

SYNTHESIS EXAMPLE 3 OF COLORED RESIN GRAIN (CPL): (CPL-3)

A mixture of a polyester resin (Chemit R-185 manufactured by Toray Co., Ltd.) having a Tg of 8° C. and polyvinyl acetate having a Tg of 38° C. as binder resins and carbon black (#30 manufacture by Mitsubishi Kasei Corp.) in a weight ratio of 1:2:1 was melted and kneaded by a three-roll mill at a temperature of 120° C. and then pulverized by a trioblender. A mixture of 5 g of the resulting coarse powder, 4 g of a dispersion stabilizing resin (Sorprene 1205 manufactured by Asahi Chemical Industry Co., Ltd.) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL with glass beads having a diameter of from 0.75 to 1 mm at a rotation of $5\times10^3$ r.p.m. for 6 hours, and then passed through a nylon cloth of 200 mesh to obtain a black dispersion which was a latex having an average grain diameter of 0.4 μm.

EXAMPLE 1

A mixture of 2 g of X-form metal-free phthalocyanine (manufactured by Dainippon Ink and Chemicals, Inc.), 14.4 g of Binder Resin (P-1) having the structure shown below, 3.6 g of Binder Resin (P-2) having the structure shown below, 0.15 g of Compound (A) having the structure shown below, and 80 g of cyclohexanone was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (P-1)

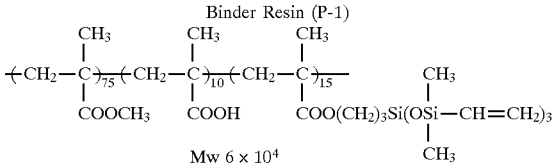

Mw $6\times10^4$

Binder Resin (P-2)

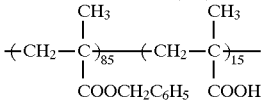

Mw $8\times10^3$

Compound (A)

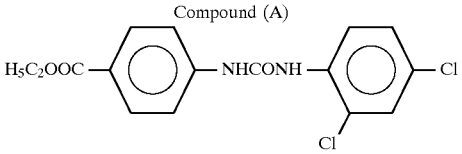

The resulting dispersion was coated on an aluminum plate having a thickness of 0.2 mm, which had been subjected to degrease treatment, by a wire bar, set to touch, and heated in a circulating oven at 110° C. for 20 seconds to form a light-sensitive layer having a thickness of 8 μm.

Then, a surface layer for imparting releasability (an overcoat layer) was provided on the light-sensitive layer.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 250 g of n-acetone was coated by a wire round rod, set to touch, and heated at 120° C. for 10 minutes to form the surface layer having a thickness of 0.5 μm. The adhesive strength of the surface of the resulting electrophotographic light-sensitive element was not more than 1 g·f.

Silicone Resin

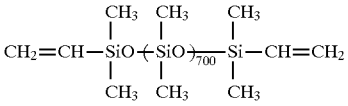

(presumptive structure)

Crosslinking Agent

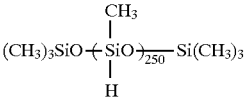

(presumptive structure)

Crosslinking Controller $CH\equiv C—Si(OCH_3)_3$

The electrophotographic light-sensitive element having the release surface thus-obtained was installed in an apparatus as shown in FIG. 1 as a light-sensitive element 11, and an intermediate transfer medium described below was installed as an intermediate transfer medium 20.

Intermediate Transfer Medium

On a surface of a blanket for offset printing (9600-A manufactured by Meiji Rubber & Co., Ltd.) having a thickness of 1.6 mm was coated an acrylic ester adhesive of re-releasable type (Saibinol MS-102 manufactured by Saiden Chemical Co., Ltd.), set to touch, and heated at 120° C. for 5 minutes to prepare a cured layer having a thickness of 5 μm. The surface adhesion force of the cured adhesive layer on the blanket measured by the method described above was 5 g·f at a temperature of 50° C. and 1.8 g·f at a temperature of 90° C. The blanket was thus-obtained fixed on a hollow drum having a temperature controller incorporated therein.

A toner image was then formed on the electrophotographic light-sensitive element by an electrophotographic process. Specifically, the electrophotographic light-sensitive element 11 whose surface temperature had been adjusted at 50° C. was charged to +450 V with a corona charger 18 in dark and image-exposed to light using a semi-conductor laser having an oscillation wavelength of 788 nm as an exposure device 19 based on digital image data of an information which had been obtained by reading an original by a color scanner, conducting several corrections relating to color reproduction specific for color separation system and stored in a hard disc at a beam spot diameter of 15 μm, a pitch of 10 μm and a scanning speed of 300 cm/sec (i.e., 2500 dpi). The exposure amount on the surface of electrophotographic light-sensitive element was 25 erg/cm$^2$.

The exposed electrophotographic light-sensitive element was subjected to reversal development using Liquid Developer (LD-1) prepared in the manner as described below by a toner image forming unit 14T while applying a bias voltage of +350 V to a development electrode of the unit to thereby electrodeposit toner particles on the exposed areas. The electrophotographic light-sensitive element was then rinsed in a bath of Isopar G alone to remove stain on the non-image portion and the toner image was dried by passing under a suction/exhaust unit 15. The remaining amount of Isopar G was 0 mg per 1 mg of the toner.

Preparation of Liquid Developer (LD-1)

1) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 6 hours to prepare a fine dispersion of nigrosine.

2) Preparation of Liquid Developer:

A mixture of 6.0 g (solid basis) of Resin Grain (PLW-2), 2.0 g (solid basis) of the above-prepared nigrosine dispersion, 0.018 g of a hexadecene/maleic acid monooctadecylamide (1/1 ratio by mole) copolymer and 10 g of branched hexadecyl alcohol (FOC-1600 manufactured by Nissan Chemical Industries, Ltd.) was diluted with 1 l of Isopar G to prepare Liquid Developer (LD-1) for electrophotography.

The drum of light-sensitive element 11, the surface temperature of which was maintained at 50° C., and the drum of intermediate transfer medium 20 whose surface temperature had been adjusted at 50° C. were brought into contact with each other under the condition of a nip pressure of 4 kgf/cm$^2$ and a drum circumferential speed of 100 mm/sec, whereby the toner image was wholly transferred onto the intermediate transfer medium.

Then, a sheet of OK Master (manufactured by Nippon Seihaku Co., Ltd.) was introduced as a final receiving material 30 between the drum of intermediate transfer medium 20 whose surface temperature was maintained at 50° C. and a back-up roller for transfer 31 adjusted at 90° C. and a back-up roller for release 32 adjusted at 25° C. and passed therebetween under a nip pressure of 6 kgf/cm$^2$ and at a drum circumferential speed of 100 mm/sec. The toner images were wholly transferred onto the sheet of OK Master.

The printing plate thus-obtained was visually observed using an optical microscope of 200 magnifications. None of toner grain was observed in the non-image portion and the image was excellent even in high definition regions or highly accurate image portions in that cutting or distortion of fine lines such as lines of 20 μm in the width, fine letters such as 2.2 point size of Ming-zhao character and dots such as a range of from 2% to 98% in dots of 150 lines per inch were not found.

Printing characteristics of the printing plate was then evaluated. Specifically, the printing plate was subjected to printing on neutral paper with various offset printing color inks using an offset printing machine (Oliver 94 Model manufactured by Sakurai Seisakusho K. K.), and an aqueous solution (pH: 7.0) prepared by diluting dampening water for PS plate (SG-23 manufactured by Tokyo Ink K. K.) 130-fold with distilled water, as dampening water. As a result, more than 10,000 prints with clear images free from background stains were obtained irrespective of the kind of color ink.

Moreover, when the printing plate according to the present invention was exchanged for an ordinary PS plate and printing was continued under ordinary conditions, no trouble arose. It was thus confirmed that the printing plate according to the present invention can share a printing machine with other offset printing plates such as PS plates.

Furthermore, the same procedure described above was repeated 299 times to prepare a 300th printing plate. Prints obtained from the 300th printing plate had the same characteristics as those from the first printing plate. As a result of measuring the adhesive strength of the surface of the electrophotographic light-sensitive element and the surface adhesion force of the intermediate transfer medium at the respective temperature, it was found that they were almost same as those in case of the first printing plate.

COMPARATIVE EXAMPLE 1

A toner image was formed on the electrophotographic light-sensitive element at room temperature, i.e., 25° C. by the electrophotographic process in the same manner as in Example 1. The toner image was squeegeed and immediately transferred onto the intermediate transfer medium without drying. When the toner image on the intermediate transfer medium was visually observed using a magnifying glass of 20 magnifications, severe streaks and cuttings of toner image were recognized as well known in the art. Also, the transfer of toner image was not completely conducted and the residue of toner was observed on the electrophotographic light-sensitive element.

COMPARATIVE EXAMPLE 2

The same procedure as in Comparative Example 1 was repeated except for conducting the transfer of toner image after drying the toner image on the electrophotographic light-sensitive element at room temperature for 10 minutes to reduce the remaining amount of Isopar G to 1 mg per 1 mg of the toner. Cuttings of fine lines and fine letters were partly observed in the toner image transferred onto the intermediate transfer medium, although streaks were not found. The residue of toner was slightly observed on the electrophotographic light-sensitive element and the complete transfer was not achieved.

COMPARATIVE EXAMPLES 3 AND 4

The same procedure as in Example 1 was repeated to evaluate the transferability and printing characteristics except for using each of Resin Grains (PLR) shown in Table E below in place of Resin Grain (PLW-2) employed in the liquid developer.

TABLE E

| Comparative Example | Resin Grain in Liquid Developer | Transferability | Printing Characteristics |
|---|---|---|---|
| 3 | PLR-1 | Complete transfer | Cuttings of image occurred in 1,000th prints |
| 4 | PLR-2 | Cutting of image occurred | Cutting of image occurred from start of printing |

As is apparent from the results shown in Table E, the printing characteristics is poor in Comparative Example 3 using Resin Grain (PLR-1) having a relatively low Tg, and on the other hand the transferability is inferior in Comparative Example 4 using Resin Grain (PLR-2) having a relatively high Tg.

COMPARATIVE EXAMPLES 5 TO 7

The same procedure as in Example 1 was repeated to evaluate the transferability except for using each adhesive shown in Table F below for the formation of cured adhesive resin layer of the intermediate transfer medium in place of the acrylic ester adhesive.

TABLE F

| Comparative Example | Adhesive | Surface Adhesion Force | First Transfer to Intermediate Transfer Medium | Second Transfer to Final Receiving Material |
|---|---|---|---|---|
| 5 | NBR number | 25 g · f at 50° C.<br>45 g · f at 90° C. | Transferability: 100%<br>Good image | Transferability: 99%<br>Disorder occurred in image |
| 6 | Silicone adhesive of addition reaction type (TSR-1520 manufactured by Toshiba Silicone Co., Ltd.) | 240 g · f at 50° C.<br>190 g · f at 90° C. | Transferability: 100%<br>Good image | Transferability: 15% |
| 7 | Acrylic ester adhesive on non-releasable type (MT-TACK5367ER-A manufactured by Mitsui Toatsu Chemicals, Inc.) | 200 g · f at 50° C.<br>55 g · f at 90° C. | Transferability: 96%<br>Cutting of image occurred | Transferability: 50% |

From the results shown in Table F, it can be seen that a slight residual toner was observed on the intermediate transfer medium and the disorder (distortion or spread) of the transferred image occurred in the second transfer step in Comparative Example 5 and the very poor transferability was observed in the second transfer step in Comparative Example 6 while the complete transfer was achieved in the first transfer step in both Comparative Examples 5 and 6.

In case of Comparative Example 7 using the acrylic ester adhesive of non-rereleasable type, the transferability was insufficient even in the first transfer step and further degraded in the second transfer step.

The transferability used herein means a ratio of a transferred image area to the whole image area and is determined by visual observation using an optical microscope of 200 magnification.

It can be seen from these results that the method of the present invention only make possible the preparation of a printing plate having good image qualities according to contact transfer of a toner image formed on a releasable surface of an electrophotographic light-sensitive element with a liquid developer via an intermediate transfer medium. Further, such good results are obtained even after the repeated plate making.

EXAMPLES 2 TO 5

Each printing plate was prepared in the same manner as in Example 1 except for using each liquid developer shown below in place of Liquid Developer (LD-1).

Preparation of Liquid Developers (LD-2) to (LD-5)

Ten grams of a dodecyl methacrylate/acrylic acid copolymer (96/4 ratio by weight), 12 g of alkali blue (organic pigment) and 35 g of Isopar G were put in a paint shaker together with glass beads and dispersed for 4 hours to prepare a fine dispersion of alkali blue.

A mixture of 6.0 g (solid basis) of each of Resin Grains (PLW) shown in Table G below, 0.5 g (solid basis) of the above-prepared alkali blue dispersion, 0.02 g of Positive-Charge Control Agent (CD-1) and 10 g of branched tetradecyl alcohol (FOC-1400 manufactured by Nissan Chemical Industries, Ltd.) was diluted with 1 l of Isopar G to prepare each of Liquid Developers (LD-2) to (LD-5).

Positive-Charge Control Agent (CD-1)

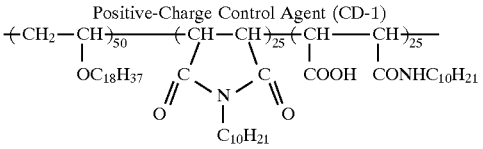

(molar ratio)

TABLE G

| Example | Liquid Developer | Resin Grain |
|---|---|---|
| 2 | LD-2 | PLW-1 |
| 3 | LD-3 | PLW-3 |
| 4 | LD-4 | PLW-5 |
| 5 | LD-5 | PLW-6 |

Each of the resulting printing plate was subjected to printing in the same manner as in Example 1. More than 10,000 prints of excellent image equivalent to those in Example 1 were obtained. After repeating the plate making, a 300th printing plate had the same characteristics as the first printing plate as in Example 1.

EXAMPLE 6

The electrophotographic light-sensitive element and intermediate transfer medium descried in Example 1 were used and the charging and image exposure were conducted under the same condition as in Example 1. Then a toner image having a stratified structure was formed in the following manner.

The exposed electrophotographic light-sensitive element was subject to reversal development using Liquid Developer (LDA-1) haveing the composition shown below while applying a bias voltage of +350 V to a development electrode of a developing device to thereby electrodeposit the toner grains on the exposed areas. The electrophotographic light-sensitive material was then rinsed in a bath of Isopar H alone to remove stains on the non-image areas. Thus, a first image layer ($G_1$) having a thickness of 2 $\mu$m was formed.

Surface electric potentials of the image portion and non-image portion were +250 V and +400 V, respectively, just after the development because the development had not been conducted up to the saturation. Successively, on the surface of electrophotographic light-sensitive element whose surface temperature was maintained at 50° C. and which was rotated at a circumferential speed of 100 mm/sec, Liquid Developer (LDB-1) having the composition shown below was supplied using a slit electrodeposition device, while applying an electric voltage of +350 V to a development electrode of the slit electrodeposition device, whereby resin grains were selectively electrodeposited on the first image layer ($G_1$), followed by passing under a suction/exhaust unit 15 and a heating means 16 to dry. Thus, a second image layer ($G_2$) composed of Resin Grain (PL-7) having a thickness of 1 $\mu$m was formed on the first image layer ($G_1$).

| | |
|---|---|
| Liquid Developer (LDA-1) | |
| Resin Grain (PL-6) (Tg 26° C.) | 6.0 g (solid basis) |
| Dispersion of Alkali Blue | 0.2 g (solid basis) |
| Positive-Charge Control Agent (CD-1) | 0.018 g |
| Branched Tectradecyl Alcohol (FOC-1400 manufactured by Nissan Chemical Industries, Ltd.) | 10.0 g |
| Isopar G | up to make 1.0 liter |
| Liquid Developer (LDB-1) | |
| Resin Grain (PL-7) (Tg 17° C.) | 6.0 g (solid basis) |
| Positive-Charge Control Agent (CD-1) | 0.018 g |
| Charge Adjuvant (AD-1) (tridecyl methacrylate/methacrylic acid (95/5 by weight ratio) copolymer) | 0.1 g |
| Isopar G | up to make 1.0 liter |

The drum of light-sensitive element bearing the toner image and the drum of intermediate transfer medium whose surface temperature had been adjusted at 50° C. were brought into contact with each other under the condition of a nip pressure of 4 kgf/cm$^2$ and a drum circumferential speed of 100 m/sec, whereby the toner image was wholly transferred onto the intermediate transfer medium.

Successively, an aluminum substrate used for the production of Fuji PS-Plate FPD (manufacturing by Fuji Photo Film Co., Ltd.) as a final receiving material 30 was introduced between the drum of intermediate transfer medium and a backup roller for transfer 31 adjusted at 90° C. and a backup roller for release 32 adjusted at 25° C., and heated and pressed under the condition of a nip pressure of 6 kgf/cm$^2$ and a drum circumferential speed of 100 mm/sec. Thus, the toner image was wholly transferred onto the aluminum support.

The printing plate thus-obtained was further heated using a device (RICOH FUSER Model 592 manufactured by Ricoh Co., Ltd.) to fix sufficiently the toner image portion. The printing plate was observed visually using an optical microscope of 200 magnifications. None of stain was observed in the non-image portion and the duplicated image was excellent even in high definition regions or highly accurate image portions in that cutting or distortion of fine lines such as lines of 10 $\mu$m in width, fine letters such as 2.2 point size of Ming-zhao character and dots such as a range of from 2% to 98% in dots of 165 lines per inch were not found.

The printing plate was gummed and subjected to offset printing in the same manner as in Example 1. As a result, more than 50,000 prints with clear images free from background stains were obtained irrespective of the kind of color inks.

As described above, for the purpose of maintaining sufficient adhesion of toner image to a final receiving material and increasing mechanical strength of toner image at the time of printing, a means for improving adhesion of toner image to a final receiving material can be performed after the heat-transfer of toner image depending on the kind of liquid developer used for the formation of toner image.

Also, similar results to the above were obtained by a flash fixing method or a heat roll fixing method as the means for improving adhesion of toner image.

EXAMPLES 7 TO 13

Each printing plate was prepared in the same manner as in Example 6 except for using a liquid developer containing each of the resin grains shown in Table H below in place of Resin Grain (PL-4) in Liquid Developer (LDA-1) and Resin Grain (PL-7) in Liquid Developer (LDB-1), respectively.

TABLE H

| Example | Liquid Developer LDA | Resin Grain in Liquid Developer LDA | Liquid Developer LDB | Resin Grain in Liquid Developer LDB |
|---|---|---|---|---|
| 7 | LDA-2 | PL-1 (Tg 31° C.) | LDB-2 | PL-4 (Tg 21° C.) |
| 8 | LDA-3 | PL-5 (Tg 26° C.) | LDB-3 | PL-7 (Tg 17° C.) |
| 9 | LDA-4 | PL-2 (Tg 38° C.) | LDB-4 | PL-4 (Tg 21° C.) |
| 10 | LDA-5 | PL-8 (Tg 34° C.) | LDB-5 | PL-9 (Tg 28° C.) |
| 11 | LDA-6 | PL-13 (Tg 28° C.) | LDB-6 | PL-10 (Tg 21° C.) |
| 12 | LDA-7 | PL-14 (Tg 29° C.) | LDB-7 | PL-12 (Tg 12° C.) |
| 13 | LDA-8 | PLW-1 (Higher Tg Component 38° C.) | LDB-8 | PL-6 (Tg 26° C.) |

Each of the printing plate thus-obtained was subjected to printing in the same manner as in Example 6. As a result, more than 50,000 prints of good images equivalent to those in Example 6 were obtained. Further, as a result of repeated plate-making, each of the 300th printing plates had the same characteristics as those of each of the first printing plates as in Example 6.

EXAMPLE 14

An amorphous silicon electrophotographic light-sensitive element (manufactured by KYOSERA Corp.) was immersed in a solution prepared by dissolving 1.5 g of Compound (S-1) for imparting surface releasability shown below in one liter of Isopar G for 10 seconds, rinsed with Isopar G and dried. Thus, the adhesive strength of the surface of amorphous silicon electrophotographic light-sensitive element was decreased from 200 g·f to 1.5 g·f, and the electrophotographic light-sensitive element exhibited good surface releasability.

Compound (S-1)
Silicone surface active agent (SILWet FZ-2171 manufactured by Nippon Unicar Co., Ltd.)

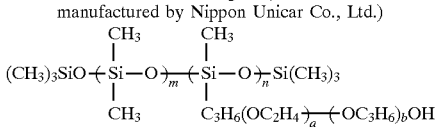

(presumptive structure)

The electrophotographic light-sensitive element having the release surface was installed in an apparatus same as in Example 1. An intermediate transfer medium of endless belt type prepared in the manner shown below was also installed in the apparatus.

Intermediate Transfer Medium

On a stainless steel plate having a thickness of 100 μm, a natural rubber sheet having a rubber hardness of 75 degree and a thickness of 0.5 mm (manufactured by Kokugo Co., Ltd.) was fixed. A latex of acrylic ester adhesive of re-releasable type (Boncoat 868 manufactured by Dainippon Ink and Chemicals, Inc.) was coated on the rubber sheet and cured by heating at 120° C. for 3 minutes to prepare a surface adhesive layer having a thickness of 1 μm. The surface adhesion force of the resulting intermediate transfer medium was 65 g·f at the first transfer temperature ($T_1$) of 60° C. and 6.5 g·f at the second transfer temperature ($T_2$) of 120° C.

The electrophotographic light-sensitive element was charged to +700 V with a corona discharge in dark and exposed to light using a semiconductor laser having an oscillation wavelength of 780 nm on the basis of digital image data of an information which had been obtained by reading an original by a color scanner, conducting several corrections relating to color reproduction specific for color separation system and stored in a hard disc. The potential in the exposed area was +220 V while it was +600 V in the unexposed area.

The exposed electrophotographic light-sensitive element was pre-bathed with Isopar H (manufactured by Esso Standard Oil Co.) by a pre-bathing means installed in a toner image forming unit and then subjected to reversal development using Liquid Developer (LDA-9) having the composition shown below while applying a bias voltage of +500 V to a development electrode to thereby electrodeposit the toner grains on the exposed areas. The electrophotographic light-sensitive element was then rinsed in a bath of Isopar H alone to remove stains on the non-image areas and dried by a suction/exhaust unit to form a first image layer ($G_1$).

| Liquid Developer (LDA-9) | |
|---|---|
| Colored Resin Grain (CPL-1) | 6.5 g (solid basis) |
| Zirconium naphthenate | 0.02 g |

-continued

| Liquid Developer (LDA-9) | |
|---|---|
| Branched octadecyl alcohol (FOC-1800 manufactured by Nissan Chemical Industries, Ltd.) | 15 g |
| Isopar G | up to make 1.0 liter |

The electrophotographic light-sensitive element bearing the first image layer ($G_1$) was again charged and exposed imagewise in the same manner as above, and subjected to reversal development using Liquid Developer (LDB-9) having the composition shown below while applying a bias voltage of +500 V to the development electrode to thereby electrodeposit the toner grains on the first image layer ($G_1$), followed by rinsing in a bath of Isopar H alone and drying by the suction/exhaust unit. Thus, a second image layer ($G_2$) was formed on the first image layer ($G_1$).

| Liquid Developer (LDB-9) | |
|---|---|
| Resin Grain (PL-10) | 6.0 g (solid basis) |
| Positive-Charge Control Agent (CD-1) | 0.018 g |
| Branched octadecyl alcohol (FOC-1800 manufactured by Nissan Chemical Industries, Ltd.) | 15 g |
| Isopar G | up to make 1.0 liter |

The electrophotographic light-sensitive element bearing the toner image was passed under an infrared line heater to adjust its surface temperature at 60° C. and brought into contact with the intermediate transfer medium whose surface temperature had been adjusted at 60° C. under the condition of a nip pressure of 4 kgf/cm$^2$ and a drum circumferential speed of 100 mm/sec, whereby the toner image was wholly transferred onto the intermediate transfer medium.

Successively, an aluminum substrate for FPD was introduced as a final receiving material 30 between the intermediate transfer medium and a backup roller for transfer 31 adjusted at 120° C. and a backup roller for release 32 adjusted at 25° C., and heated and pressed under the condition of a nip pressure of 4 kgf/cm$^2$ and a transportation speed of 100 mm/sec. Thus, the toner image was wholly transferred onto the aluminum support.

The printing plate was passed between heat rollers whose surface temperature had been adjusted at 130° C. at a nip pressure of 4 kgf/cm$^2$ and a transportation speed of 2 cm/sec. to fix sufficiently the toner image portion.

The printing plate thus obtained was observed visually using an optical microscope of 200 magnifications. It was found that the non-image portion had no stain, and the image portion suffered no defect (i.e., cutting of fine lines, fine letters and dots) in high definition regions or highly accurate image portion.

The printing plate was gummed and subjected to offset printing in the same manner as in Example 1. As a result, more than 50,000 prints with clear images free from background stains were obtained irrespective of the kind of color inks. Further, as a result of repeated plate-making, the 500th printing plate had the same characteristics as those of the first printing plate.

EXAMPLE 15

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. To the mixture was added 520 g of tetrahydrofuran with stirring. The resulting dispersion was coated on an aluminum plate described in Example 1 by a wire round rod to prepare a charge generating layer having a thickness of about 0.7 μm.

Bisazo Pigment

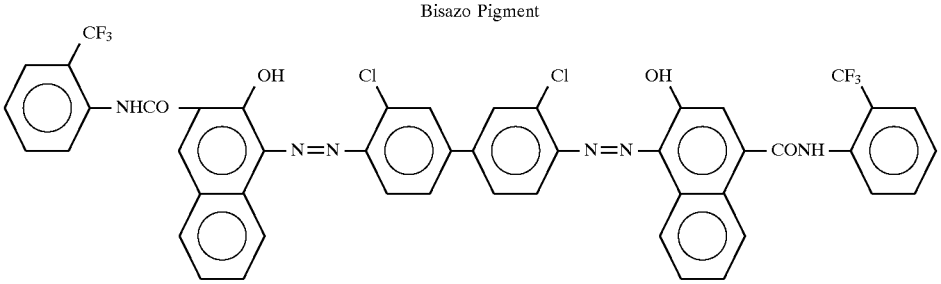

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

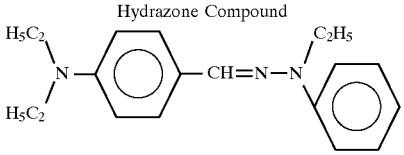

A mixed solution of 6 g of Resin (PP-1) having the structure shown below, 0.1 g of phthalic anhydride, 0.02 g of phthalic acid and 100 g of toluene was coated on the light-sensitive layer by a wire round rod, set to touch and heated at 140° C. for one hour to prepare a surface layer for imparting releasability having a thickness of 0.7 μm. The adhesive strength of the surface of the resulting electrophotographic light-sensitive element was not more than 1 g·f.

Resin (PP-1)

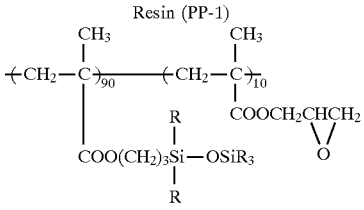

R: —OSi(CH3)3
Mw 6 × 10^4

On a hollow drum equipped with a temperature controller therein was provided a silicone rubber layer having a rubber hardness of 45 degree and a thickness of 2 mm, as a heat-resistant elastic material layer. An adhesive solution having the composition shown below was coated on the elastic material layer and cured by heating at 120° C. for 10 minutes to prepare an adhesive layer having a thickness of 2 μm. The surface adhesion force of the resulting intermediate transfer medium was 80 g·f at the first transfer temperature ($T_1$) of 50° C. and 10 g·f at the second transfer temperature ($T_2$) of 100° C.

| Adhesive Solution | |
|---|---|
| Polypropylene oxide terminated with methyl dimethoxysilyl group (Syryl 5A-01 manufactured by Kaneka Corp.) | 8 g |
| Adhesion Imparting Agent (Stebelit Ester 10 manufactured by Riken Hercules Co., Ltd.) | 3.8 g |
| A 10% toluene solution of aluminum triethyl acetate | 1.3 g |

The electrophotographic light-sensitive element was charged to a surface electric potential of −500 V in dark and exposed imagewise using a helium-neon laser of 633 nm at an irradiation dose on the surface of the electrophotographic light-sensitive element of 25 erg/cm$^2$. Then, it was developed using Liquid Developer (LDA-10) having the composition shown below while applying a bias voltage of −50 V, and successively developed using Liquid Developer (LDB-10) having the composition shown below, followed by rinsing with Isopar G.

| Liquid Developer (LDA-10) | |
|---|---|
| Colored Resin Grain (CPL-2) | 6.5 g (solid basis) |
| Positive-Charge Control Agent (CD-1) | 0.018 g |
| Branched Tectradecyl Alcohol (FOC-1400 manufactured by Nissan Chemical Industries, Ltd.) | 10.0 g |
| Isopar G | up to make 1.0 liter |
| **Liquid Developer (LDB-10)** | |
| Resin Grain (PL-4) | 6.0 g (solid basis) |
| Positive-Charge Control Agent (CD-1) | 0.018 g |
| Branched Tectradecyl Alcohol (FOC-1400 manufactured by Nissan Chemical Industries, Ltd.) | 10.0 g |
| Isopar G | up to make 1.0 liter |

The electrophotographic light-sensitive element bearing the toner image was passed under an infrared line heater to adjust its surface temperature at 50° C. and brought into contact with the intermediate transfer medium whose surface temperature had been adjusted at 50° C. under the condition of a nip pressure of 4 kgf/cm$^2$ and a drum circumferential speed of 100 mm/sec, whereby the toner image was wholly transferred onto the intermediate transfer medium.

Successively, a sheet of OK Master (manufactured by Nippon Seihaku Co., Ltd.) was introduced as a final receiving material 30 between the drum of intermediate transfer medium and a back-up roller for transfer 31 adjusted at 100° C. and back-up roller for release 32 adjusted at 25° C., and heated and pressed at a nip pressure of 6 kgf/cm$^2$ and a drum circumferential speed of 100 mm/sec. The toner image was wholly transferred onto the sheet of OK Master.

The printing plate was passed between heat rollers whose surface temperature had been adjusted at 130° C. at a nip pressure of 4 kgf/cm$^2$ and a transportation speed of 2 cm/sec. to fix sufficiently the toner image portion.

The printing plate thus obtained was observed visually using an optical microscope of 200 magnifications. It was found that the non-image portion had no stain, and the image portion suffered no defect (i.e., cutting of fine lines, fine letters and dots) in high definition regions or highly accurate image portion.

The printing plate was gummed and subjected to offset printing in the same manner as in Example 1. As a result, more than 10,000 prints with clear images free from background stains were obtained irrespective of the kind of color inks. Further, as a result of repeated plate-making, the 500th printing plate had the same characteristics as those of the first printing plate.

EXAMPLE 16

Five g of 4,4'-bis(diethylamino)-2,2'-dimethyltriphenylmethane as an organic photoconductive substance, 4 g of Binder Resin (P-3) having the structure shown below, 40 mg of Dye (D-1) having the structure shown below and 0.2 g of Anilide Compound (A) having the structure shown below as a chemical sensitizer were dissolved in a mixed solvent of 30 ml of methylene chloride and 30 ml of ethylene chloride to prepare a solution for light-sensitive layer.

Binder Resin (P-3)

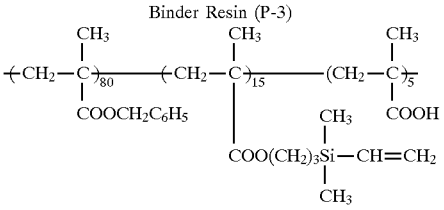

Mw 5.5 × 10$^4$

-continued

Dye (D-1)

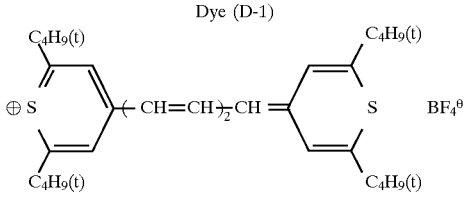

Anilide Compound (B)

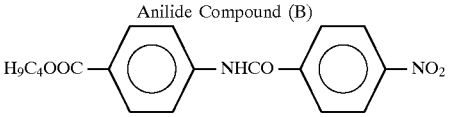

The resulting solution for light-sensitive layer was coated on a conductive transparent substrate composed of a 100 μm thick polyethylene terephthalate film having a deposited layer of indium oxide thereon (surface resistivity: $10^3$ Ω) by a wire round rod to prepare an electrophotographic light-sensitive element having an organic light-sensitive layer having a thickness of about 4 μm.

A mixed solution of 9 g of a silicone rubber polymer having the structure shown below, 400 mg of a crosslinking agent having the structure shown below, 40 mg of a catalyst (X92-1114 manufactured by Shin-Etsu Silicone Co., Ltd.) and 150 g of heptane was uniformly coated on the electrophotographic light-sensitive element by a wire bar and heated at 90° C. for 2 minutes to conduct drying and crosslinking, thereby forming a surface layer for imparting releasability having a thickness of 1.0 μm. The adhesive strength of the surface of the resulting electrophotographic light-sensitive element was not more than 1 g·f.

Silicone Rubber Polymer

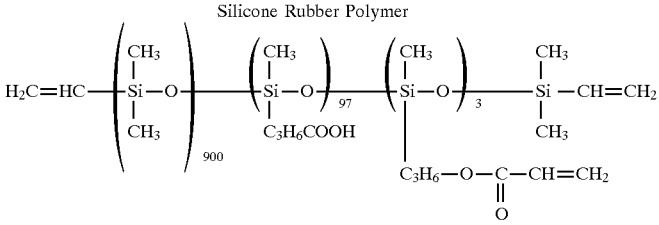

Crosslinking Agent

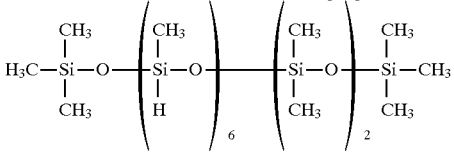

The procedure same as in Example 1 was repeated except for using the electrophotographic light-sensitive element in place of the electrophotographic light-sensitive element employed in Example 1 to prepare a printing plate. Using the printing plate, printing was conducted in the same manner as in Example 1. The prints obtained had clear images without the formation of background stain and printing durability of the printing plate was good similar to Example 1.

Further, as a result of repeated plate-making, the 500th printing plate had the same characteristics as those of the first printing plate.

While the invention has been described in detail and with reference to specific embodiment thereof, it will be apparent to one skilled in the art that various changes and modifications can be made therein without departing from the spirit and scope thereof.

What is claimed is:

1. A method for preparation of a printing plate by an electrophotographic process comprising, in order, a) forming a toner image on an electrophotographic light-sensitive element having a release surface by an electrophotographic process using a liquid developer comprising a dispersion medium having dispersed therein toner grains each containing at least one resin (A) having a glass transition point of from 20° C. to 80° C. or a softening point of from 35° C. to 100° C. and at least one resin (B) having a glass transition point or a softening point at least 2° C. lower than that of the resin (A), b) drying the toner image to remove the dispersion medium thereby causing at least partial adhesion between the toner grains, c) bringing the toner image into contact with an intermediate transfer medium having a surface adhesion force of not less than 3 gram·force at temperature ($T_1$) and not more than 40 gram·force at temperature ($T_2$), at the temperature ($T_1$) to transfer the toner image onto the intermediate transfer medium, and d) bringing the toner image into contact with a final receiving material having a surface providing a hydrophilic surface for lithographic printing at the time of printing at the temperature ($T_2$) higher than the temperature ($T_1$) to transfer the toner image onto the final receiving material.

2. A method for preparation of a printing plate by an electrophotographic process as claimed in claim 1, wherein the surface of electrophotographic light-sensitive element has an adhesive strength of not more than 20 gram·force at the time of the formation of toner image.

3. A method for preparation of a printing plate by an electrophotographic process as claimed in claim 2, wherein the electrophotographic light-sensitive element comprises a surface-modified amorphous silicon as a photoconductive substance.

4. A method for preparation of a printing plate by an electrophotographic process as claimed in claim 2, wherein the electrophotographic light-sensitive element comprising a photoconductive layer provided thereon an overcoat layer containing a polymer which has a polymer component containing at least one of a silicon atom and a fluorine atom and is crosslinked in the region near to the outer surface thereof.

5. A method for preparation of a printing plate by an electrophotographic process as claimed in claim 4, wherein the overcoat layer has a surface energy of not more than 30 erg·cm$^{-1}$.

6. A method for preparation of a printing plate by an electrophotographic process as claimed in claim 4, wherein the overcoat layer contains a fluorinated resin.

7. A method for preparation of a printing plate by an electrophotographic process as claimed in claim 6, wherein the fluorinated resin comprises a polymer component containing a moiety having a fluorine atom and contains a curable functional group.

8. A method for preparation of a printing plate by an electrophotographic process as claimed in claim 4, wherein the overcoat layer contains a silicone resin.

9. A method for preparation of a printing plate by an electrophotographic process as claimed in claim 8, wherein the silicone resin comprises an organo siloxane repeating unit represented by the following general formula (I):

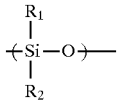

(I)

wherein $R_1$ and $R_2$, which may be the same or different, each represents an aliphatic or aromatic hydrocarbon group or a heterocyclic group.

10. A method for preparation of a printing plate by an electrophotographic process as claimed in claim 1, wherein the toner grains have a core/shell structure.

11. A method for preparation of a printing plate by an electrophotographic process as claimed in claim 1, wherein the toner image after drying step b) has a thickness of from 0.3 to 10 μm.

12. A method for preparation of a printing plate by an electrophotographic process as claimed in claim 1, wherein the temperature ($T_1$) is in a range of from 35° C. to 70° C.

13. A method for preparation of a printing plate by an electrophotographic process as claimed in claim 1, wherein the temperature ($T_2$) is in a range of from 45° C. to 120° C.

14. A method for preparation of a printing plate by an electrophotographic process as claimed in claim 1, wherein the intermediate transfer medium has an adhesive resin layer.

15. A method for preparation of a printing plate by an electrophotographic process as claimed in claim 14, wherein the intermediate transfer medium further has an elastic material layer having a thickness greater than the thickness of toner image to be transferred under the adhesive resin layer.

16. A method for preparation of a printing plate by an electrophotographic process comprising, in order, a-1) forming a toner image on an electrophotographic light-sensitive element having a release surface by an electrophotographic process using a liquid developer comprising a dispersion medium having dispersed therein toner grains wherein the toner image has a stratified structure composed of a first image layer ($G_1$) formed from toner grains containing a resin (A) having a glass transition point of from 20° C. to 80° C. or a softening point of from 35° C. to 100° C. and provided thereon a second image layer ($G_2$) formed from toner grains containing a resin (B) having a glass transition point or a softening point at least 2° C. lower than that of the resin (A), b) drying the toner image to remove the dispersion medium thereby causing at least partial adhesion between the toner grains, c) bringing the toner image into contact with an intermediate transfer medium having a surface adhesion force of not less than 3 gram·force at temperature ($T_1$) and not more than 40 gram·force at temperature ($T_2$), at the temperature ($T_1$) to transfer the toner image onto the intermediate transfer medium, and d) bringing the toner image into contact with a final receiving material having a surface providing a hydrophilic surface for lithographic printing at the time of printing at the temperature ($T_2$) higher than the temperature ($T_1$) to transfer the toner image onto the final receiving material.

17. A method for preparation of a printing plate by an electrophotographic process as claimed in claim 16, wherein the step of forming the toner image having a stratified structure comprises a step of forming the first image layer ($G_1$) using a liquid developer comprising a dispersion medium having dispersed therein toner grains containing the resin (A) and then a step of forming the second image layer ($G_2$) on the first image layer ($G_1$) using a liquid developer comprising a dispersion medium having dispersed therein toner grains containing the resin (B).

18. A method for preparation of a printing plate by an electrophotographic process as claimed in claim 16, wherein the second image layer ($G_2$) contains no colorant.

* * * * *